US008919898B2

(12) United States Patent
Yamasaki

(10) Patent No.: US 8,919,898 B2
(45) Date of Patent: Dec. 30, 2014

(54) NAIL PRINT APPARATUS INCLUDING DISPLAY CONTROL UNIT DISTINGUISHING BETWEEN FINGERNAIL UNDER PRINTING AND FINGERNAIL NOT UNDER PRINTING TO DISPLAY FINGERNAIL

(75) Inventor: Shuichi Yamasaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 57 days.

(21) Appl. No.: 13/615,428

(22) Filed: Sep. 13, 2012

(65) Prior Publication Data

US 2013/0083098 A1 Apr. 4, 2013

(30) Foreign Application Priority Data

Sep. 29, 2011 (JP) ..... 2011-215109
Jul. 4, 2012 (JP) ..... 2012-150047

(51) Int. Cl.
*B41J 3/00* (2006.01)

(52) U.S. Cl.
USPC ..... 347/2; 347/3; 132/73

(58) Field of Classification Search
USPC ..... 347/2, 3, 4, 5; 132/73
See application file for complete search history.

(56) References Cited

U.S. PATENT DOCUMENTS 6,286,517 B1 * 9/2001 Weber et al. ..... 132/73
6,525,724 B1 2/2003 Takami

FOREIGN PATENT DOCUMENTS

JP 2000-194838 A 7/2000
JP 2002-165632 A 6/2002

* cited by examiner

*Primary Examiner* — Lam S Nguyen
(74) *Attorney, Agent, or Firm* — Holtz, Holtz, Goodman & Chick PC

(57) ABSTRACT

A nail print apparatus includes a print head and a display control unit. The print head performs printing on a plurality of fingernails. The display control unit distinguishes between an under-printing fingernail and a not-under-printing fingernail to display the fingernails. The under-printing fingernail is a fingernail under printing performed by the print head. The not-under-printing fingernail is a fingernail not under printing performed by the print head.

18 Claims, 25 Drawing Sheets

FIG. 8

58

| | NAIL Ta | NAIL Tb | NAIL Tc | NAIL Td | |
|---|---|---|---|---|---|
| IDENTIFICATION NUMBER | 1 | 2 | 3 | 4 | 58a |
| PRINT STATUS | DONE | DONE | IN PROGRESS | NOT YET | 58b |
| X COORDINATE | Xa | Xb | Xc | Xd | 58c |
| Y COORDINATE | Ya | Yb | Yc | Yd | 58d |
| NAIL DESIGN IMAGE'S ADDRESS | ADDRESS a | ADDRESS b | ADDRESS c | ADDRESS d | 58e |

NAIL PRINT APPARATUS INCLUDING DISPLAY CONTROL UNIT DISTINGUISHING BETWEEN FINGERNAIL UNDER PRINTING AND FINGERNAIL NOT UNDER PRINTING TO DISPLAY FINGERNAIL

BACKGROUND OF THE INVENTION

1. Field of the Invention

The present invention relates to a nail print apparatus including a display control unit which distinguishes between a fingernail under printing and fingernails not under printing to display the fingernails.

2. Description of the Related Art

Japanese Patent Application Laid-Open Publications No. 2000-194838 and No. 2002-165632 propose nail print apparatuses which print nail designs, such as various colors and patterns, on fingernails. By using these nail print apparatuses, a user can readily enjoy nail printing at home or the like without going to a store such as a nail salon.

When a user would like to have nails of fingers of his/her hand, such as the index finger, the middle finger, the ring finger and the little finger, done with the nail print apparatus, the user places the fingers on a placement table, and printing is performed on the nails by a print head of the nail print apparatus. At the time, if the fingers are simply placed on the placement table, the fingers move because the hand is unstable thereon, and consequently a print image may be shifted or bad. Hence, the user needs to keep the hand still thereon.

However, it is hard for a user to keep his/her all the fingers still, the fingers, such as the index finger, the middle finger, the ring finger and the little finger, on the nails of which printing is intended to be performed, for a long time until the printing is performed on all the nails.

Then, there has been developed a nail print apparatus which does not perform printing with a print head on fingernails in parallel, but performs printing with a print head thereon successively. By using this nail print apparatus, a user can move fingers, the nails of which are not under printing, a little while keeping a finger, the nail of which is under printing, still. Accordingly, the printing can be performed while a user is relaxed.

However, the print head is positioned over the fingernails during the printing, and hence a user cannot see which fingernail is under printing, and which fingernail is not.

Consequently, a user cannot move any of the fingers after all, and may even feel irritated because of not knowing the progress of the printing.

In view of the circumstances, an object of the present invention is to provide a nail print apparatus which can inform a user which fingernail is under printing, and which fingernail is not under printing.

BRIEF SUMMARY OF THE INVENTION

According to an aspect of the present invention, there is provided a nail print apparatus including: a print head which performs printing on a plurality of fingernails; and a display control unit which distinguishes between an under-printing fingernail under the printing performed by the print head and a not-under-printing fingernail not under the printing performed by the print head to display the fingernails.

BRIEF DESCRIPTION OF THE SEVERAL VIEWS OF THE DRAWING

FIG. 8 shows a nail print control table;

DETAILED DESCRIPTION OF THE INVENTION

First Embodiment

Referring to FIGS. 1 to 13, a nail print apparatus in accordance with a first embodiment of the present invention is described. In the following embodiments, various limits which are technically preferred to realize the present invention are given. However, the following embodiments and the accompanying drawings are not intended to limit the scope of the present invention.

Figure 1:
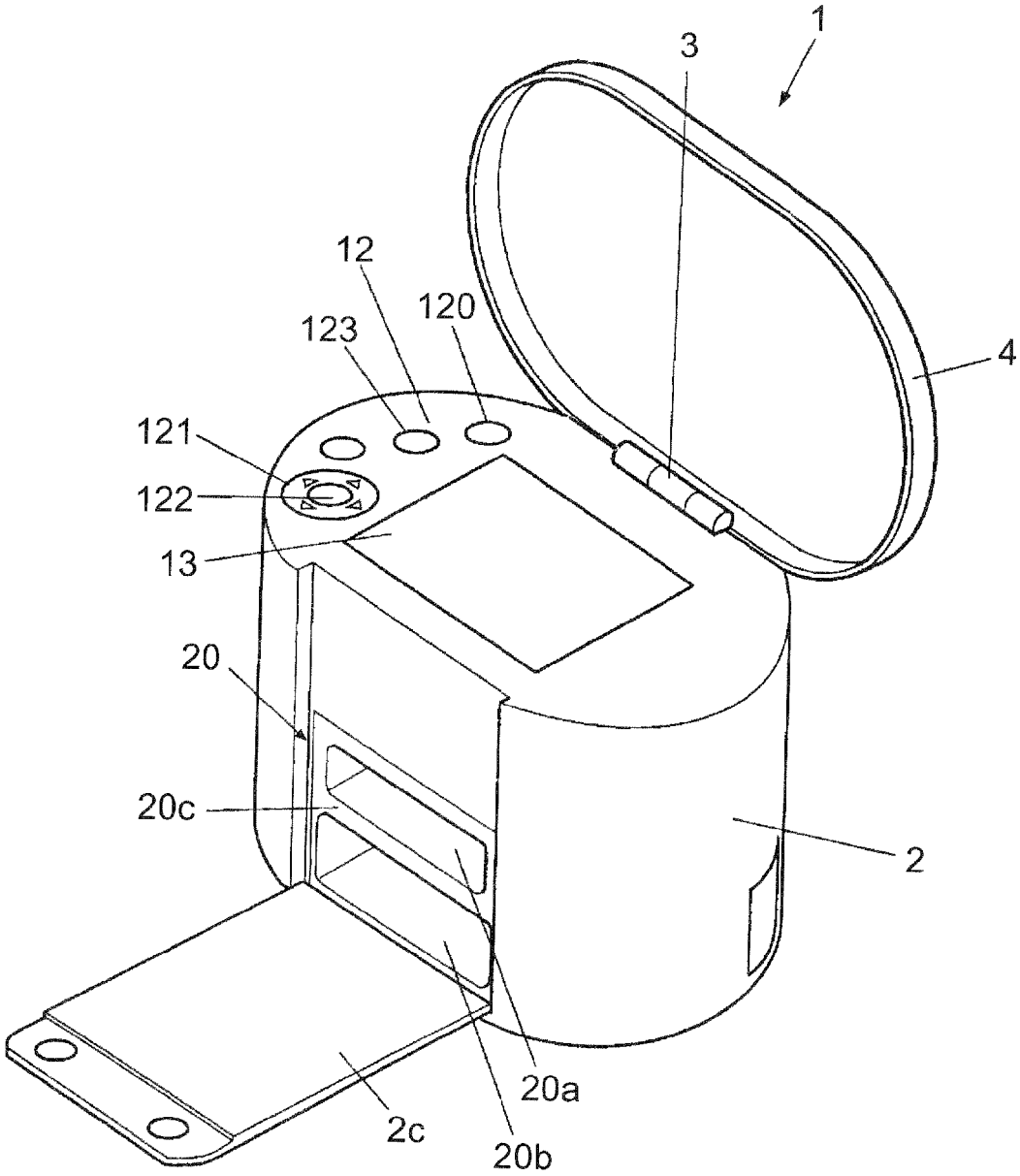
FIG. 1 is a perspective view conceptually showing a nail print apparatus in accordance with embodiments of the present invention, the cover of the nail print apparatus being open.
Figure 2:
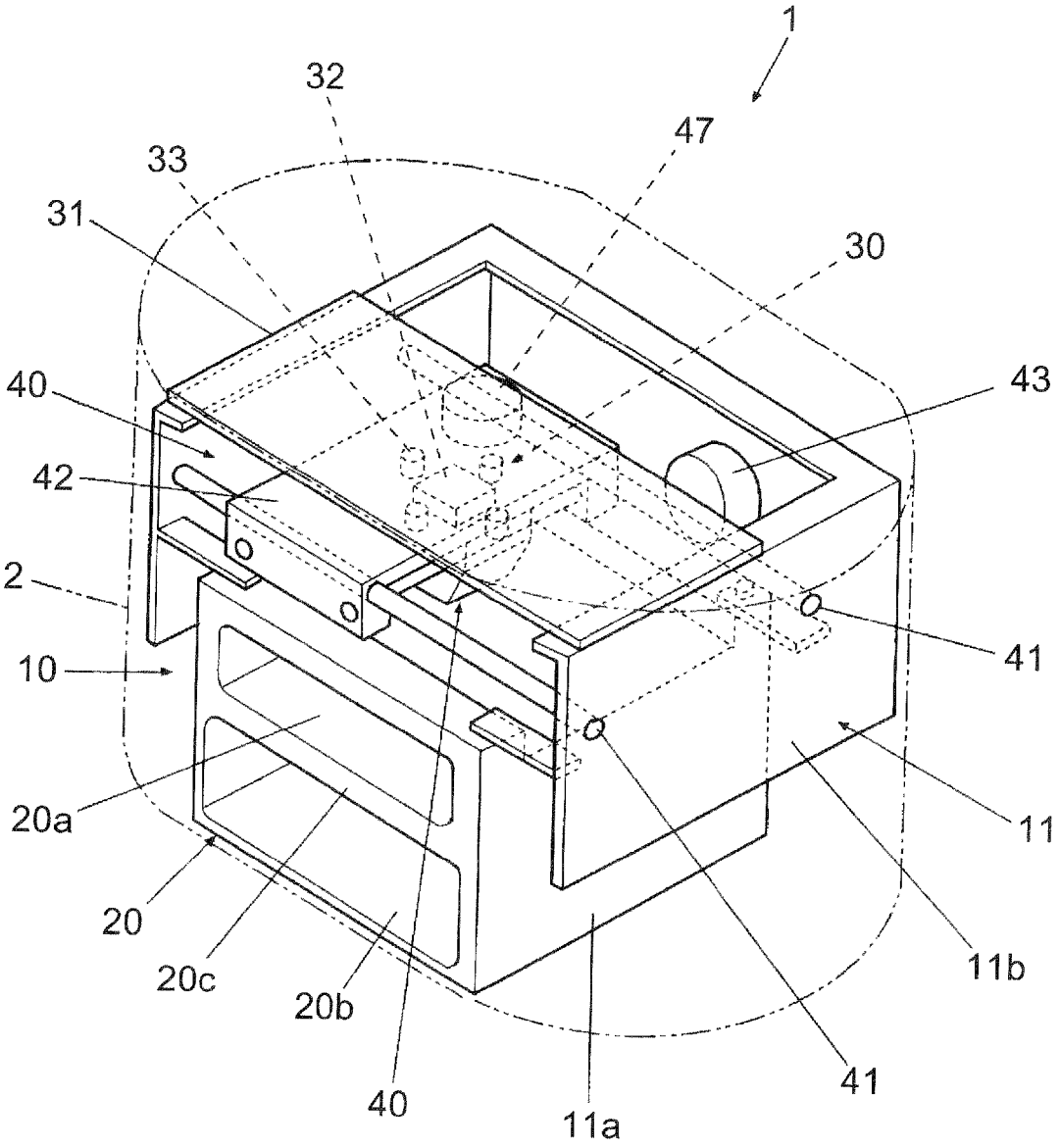
FIG. 2 is a perspective view conceptually showing the main body of the nail print apparatus shown in FIG. 1.

FIG. 1 is a perspective view showing the external appearance of a nail print apparatus 1 in the embodiment. FIG. 2 is a perspective view showing the internal configuration of the nail print apparatus 1.

As shown in FIG. 1, the nail print apparatus 1 includes a case 2 and a cover 4. The case 2 and the cover 4 are connected with each other via a hinge 3 disposed at the rear end of the upper surface of the case 2.

The case 2 is formed to be oval in a planar view. At the front side of the case 2, an open-and-close plate 2*c* is provided to be able to rise and fall. The open-and-close plate 2*c* is connected to the case 2 via a hinge (not shown) disposed at the lower end of the front surface of the case 2. The open-and-close plate 2*c* is for opening and closing the front surface of the case 2.

An operation unit 12 is disposed on the upper surface (top board) of the case 2, and a display unit 13 is disposed at the approximate center of the upper surface (top board).

The shapes and configurations of the case 2 and the cover 4 are not limited to those exemplified here.

A main body 10 of the nail print apparatus 1 is housed in the case 2. The main body 10 includes a printing finger fixing unit 20, a photographing unit (i.e. an image pickup unit) 30, and a print unit 40, which are shown in FIG. 2, and a control device 50 (shown in FIG. 6). The printing finger fixing unit 20, the photographing unit 30, the print unit 40, and the control device 50 are disposed in a machine casing 11.

The machine casing 11 includes a lower machine casing 11*a* and an upper machine casing 11*b*. The lower machine casing 11*a* is formed in the shape of a box. The lower machine casing 11*a* is disposed at a lower part in the case 2. The upper machine casing 11*b* is disposed over the lower machine casing 11*a* inside the case 2, so as to be disposed at an upper part in the case 2.

The printing finger fixing unit 20 is disposed in the lower machine casing 11*a* of the machine casing 11. The printing finger fixing unit. 20 includes a printing finger insertion unit 20*a*, a non-printing finger insertion unit 20*b*, and a holding unit 20*c* which are disposed in the lower machine casing 11*a*.

The printing finger insertion unit 20*a* is a finger insertion unit where fingers (printing fingers, hereinafter) U1 having nails T on which printing is performed are inserted. (Refer to FIG. 3.) The bottom (a printing finger placement surface) functions as a finger placement unit where printing fingers U1 are placed. Photography of printing fingers U1 and printing on printing fingers U1 are performed in a state in which the printing fingers U1 are placed on the printing finger placement surface, which functions as the finger placement unit.

The non-printing finger insertion unit 20*b* is a finger insertion unit where fingers (non-printing fingers, hereinafter) U2 other than the printing fingers U1 are inserted. (Refer to FIG. 3.)

The holding unit 20*c* is a portion which can be held by the printing fingers U1 inserted into the printing finger insertion unit 20*a* and the non-printing fingers U2 inserted into the non-printing finger insertion unit 20*b*. In the embodiment, the holding unit 20*c* is constituted of a partition 21 which separates the printing finger insertion unit 20*a* from the non-printing finger insertion unit 20*b*.

Figure 3:
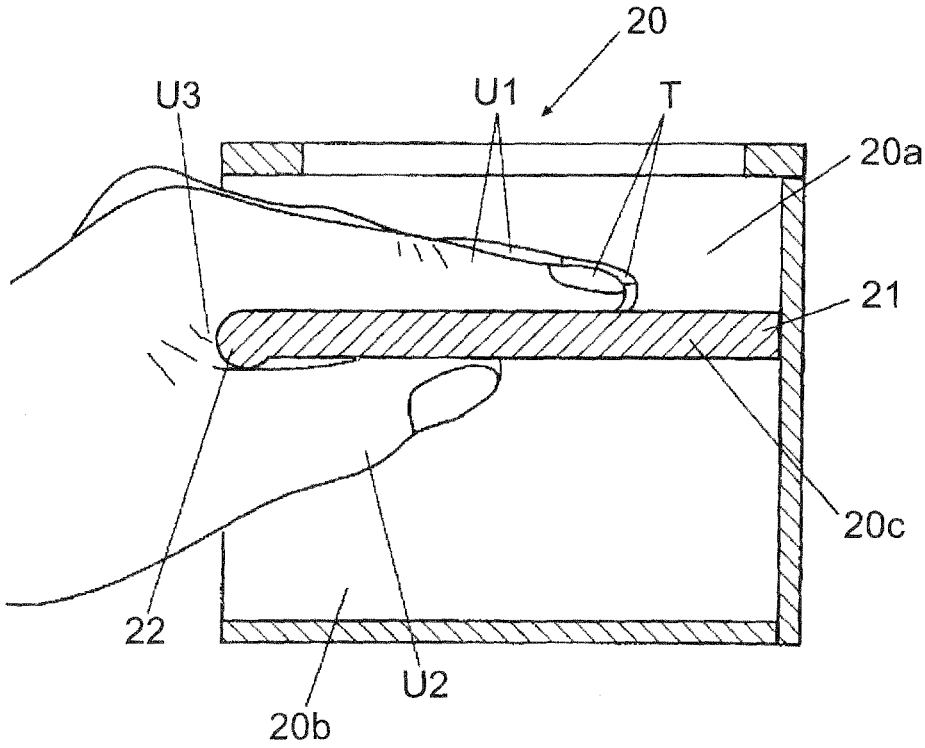
FIG. 3 is a cross-sectional view showing a printing finger fixing unit of the nail print apparatus shown in FIG. 1, the printing finger fixing unit including a printing finger insertion unit where an index finger, a middle finger, a ring finger and a little finger as printing fingers are inserted and fixed.

The upper surface of the partition 21 constitutes the flat printing finger placement surface. A bulged portion 22 is formed at an edge part of the partition 21, the edge part from which fingers are inserted. The bulged portion 22 is formed at a part which bases U3 of printing fingers U1 and non-printing fingers U2 touch when the printing fingers U1 and the non-printing fingers U2 are deeply inserted into the printing finger insertion unit 20*a* and the non-printing finger insertion unit 20*b*, respectively. As shown in FIG. 3, the cross-sectional shape of the bulged portion 22 is a circular shape that bulges downward from the lower surface of the partition 21 so that the partition 21 (the holding unit 20*c*) can be firmly held by the printing fingers U1 and the non-printing fingers U2 with the whole ball of each of the printing fingers U1 touching the printing finger placement surface. The cross-sectional shape of the bulged portion 22 is not limited to the circular shape, and hence the cross-sectional shape thereof can be an oval shape or a non-circular shape such as a polygonal shape.

In a case where four fingers (the index finger, the middle finger, the ring finger, and the little finger) other than the thumb of a hand of a user are printing fingers U1, as shown in FIG. 3, the user inserts the four fingers into the printing finger insertion unit 20*a*, and inserts the thumb as a non-printing finger U2 into the non-printing finger insertion unit 20*b*. In this case, the printing fingers U1 are fixed on the holding unit 20*c* by the user holding the holding unit 20*c* with the printing fingers U1 inserted into the printing finger insertion unit 20*a* and the non-printing finger U2 inserted into the non-printing finger insertion unit 20*b*.

Furthermore, in a case where the thumb is the only printing finger U1, the user inserts the thumb (printing finger U1) into the printing finger insertion unit 20*a*, and inserts the other four fingers (non-printing fingers U2) into the non-printing finger insertion unit 20*b*. In this case, the printing finger U1 is fixed on the holding unit 20*c* by the user holding the holding unit 20*c* with the printing finger U1 and the non-printing fingers U2.

Figure 4:
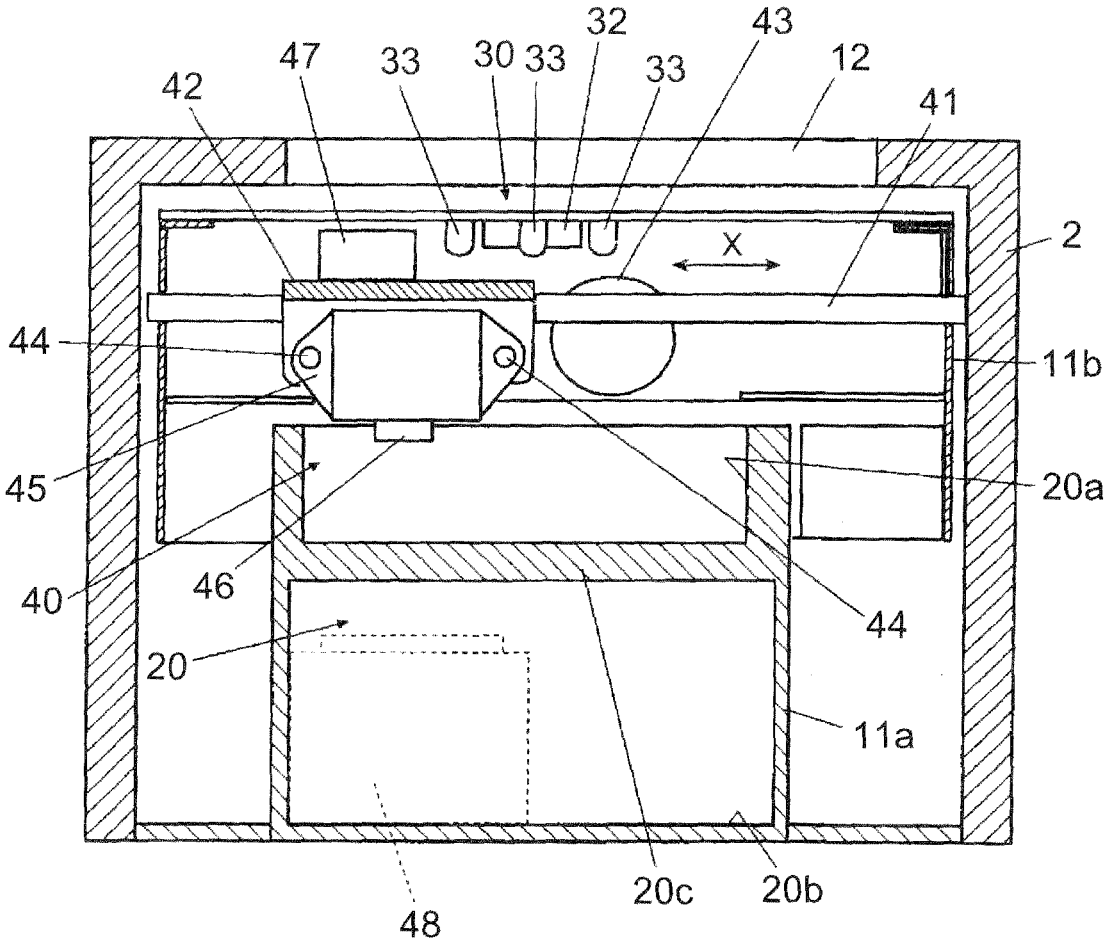
FIG. 4 is a cross-sectional view of the nail print apparatus shown in FIG. 1, giving a view from the front.
Figure 5:
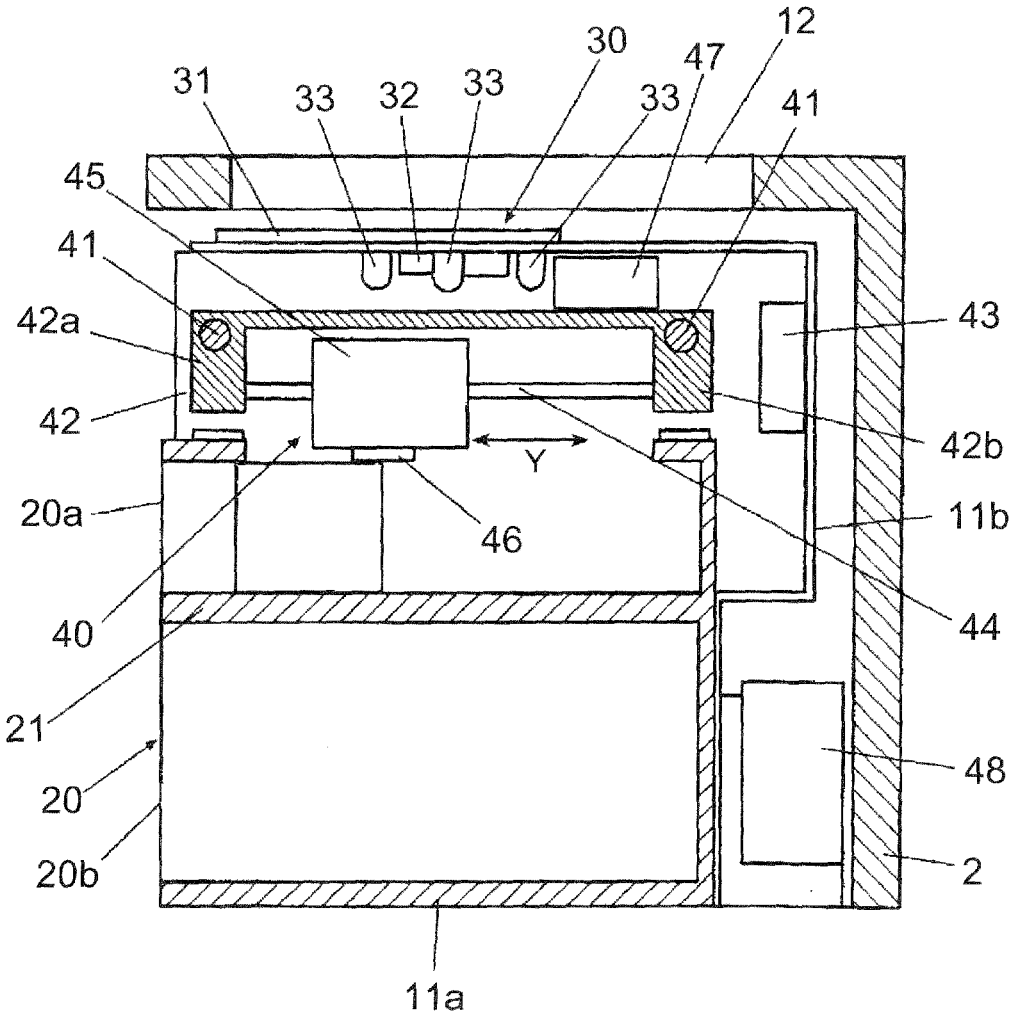
FIG. 5 is a cross-sectional view of the nail print apparatus shown in FIG. 1, giving a view from the side.

FIG. 4 is a cross-sectional view of the nail print apparatus 1, giving a view from the front. FIG. 5 is a cross-sectional view of the nail print apparatus 1, giving a view from the side.

As shown in FIGS. 4 and 5, the photographing unit 30 is disposed on the upper machine casing 11*b* of the machine casing 11.

That is, an electronic camera 32 having about two million pixels or more and including a built-in driver is disposed at the center of the lower surface of a substrate 31 disposed on the upper machine casing 11*b*. In addition, lights 33 such as white LEDs are disposed in such a way as to surround the electronic camera 32. The photographing unit 30 includes the electronic camera 32 and the lights 33.

The photographing unit 30 is an image obtaining unit which illuminates printing fingers U1 placed on the printing finger placement surface of the printing finger insertion unit 20*a* with the lights 33, and photographs the printing fingers U1 with the electronic camera 32, so as to obtain finger images including nail region images (nail images) corresponding to the nails T of the printing fingers U1. The photographing unit 30 functions as a photographing unit to obtain nail images. The photographing unit 30 is connected to the control device 50 (described below) to be controlled by the control device 50.

The print unit 40 prints colors, patterns and the like on the nails T (shown in FIG. 3) of printing fingers U1. In the embodiment, the print unit 40 is mainly disposed in the upper machine casing 11*b*. That is, as shown in FIGS. 4 and 5, two guide rods 41 are bridged in parallel between two sideboards of the upper machine casing 11*b*. A main carriage 42 is attached to the guide rods 41 in such a way as to slide thereon. As shown in FIG. 5, two guide rods 44 are bridged in parallel between a front wall 42*a* and a back wall 42*b* of the main carriage 42. A secondary carriage 45 is attached to the guide rods 44 in such a way as to slide thereon. The print head 46 is mounted on the secondary carriage 45 at the center of the lower surface thereof.

In the embodiment, the print head 46 is an inkjet print head which makes ink fine droplets, and directly sprays the fine droplets to a printing medium. The recording method of the print head 46 is not limited to the inkjet method.

The main carriage 42 is connected to a motor 43 via a power transmitting unit (not shown), and moves in the right-left direction along the guide rods 41 by forward-reversal rotation of the motor 43. The secondary carriage 45 is connected to a motor 47 via a power transmitting unit (not shown), and moves in the front-back direction along the guide rods 44 by forward-reversal rotation of the motor 47. The right-left direction along the guide rods 41 is referred to as an X direction, and the front-back direction along the guide rods 44 is referred to as a Y direction.

Figure 6:
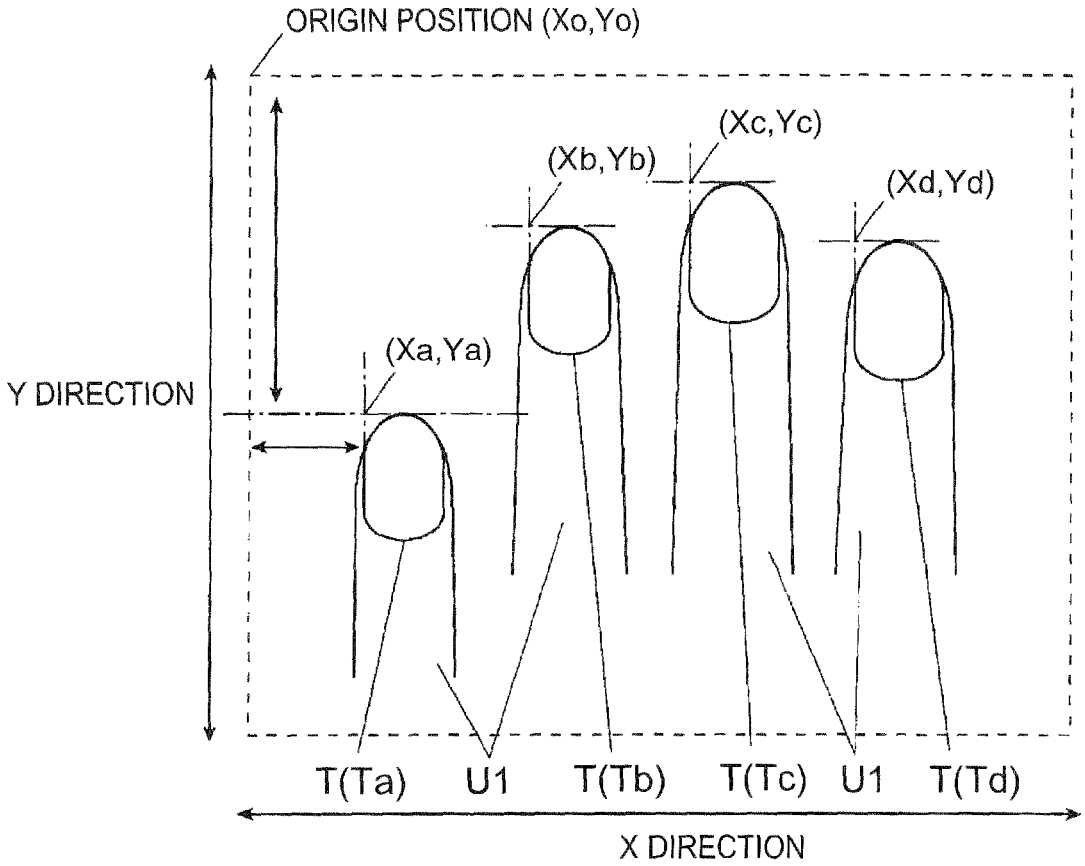
FIG. 6 is a plan view showing the index finger, the middle finger, the ring finger and the little finger as the printing fingers inserted into the printing finger insertion unit.

As shown in FIG. 6, a position of the print head 46 and reference positions (Xa, Ya), (Xb, Yb), (Xc, Yc) and (Xd, Yd) of the nails T (nails Ta, Tb, Tc and Td) of printing fingers U1 are shown in an XY Cartesian coordinate system with a predetermined origin position (Xo, Yo) as a fiducial point. Each of the reference positions (Xa, Ya), (Xb, Yb) (Xc, Yc) and (Xd, Yd) of the nails T (nails Ta, Tb, Tc and Td) of printing fingers U1 is determined by a Y coordinate of the tip of the nail T and an X coordinate of the left end of the nail T.

An ink cartridge 48 which supplies ink to the print head 46 is disposed in the lower machine casing 11*a*. The ink cartridge 48 is connected to the print head 46 via an ink supply tube (not shown), and supplies ink to the print head 46 as needed. An ink cartridge may be mounted on the print head 46 itself.

The print unit 40 includes the guide rods 41, the main carriage 42, the motor 43, the guide rods 44, the secondary carriage 45, the print head 46, the motor 47, and the ink cartridge 48.

The operation unit 12 is an input device with which a user performs various inputs. When a user operates the operation unit 12, the operation unit 12 outputs an operation signal in accordance with the operation. In the embodiment, as shown in FIG. 1, the operation unit 12 includes a power button 120 to turn on power of the nail print apparatus 1, a setting button 121 to specify a nail design image, a decision button 122, and a print button 123 to start printing, for example.

The display unit 13 is a display unit constituted of a liquid crystal panel (LCD: Liquid Crystal Display) or the like.

A touch panel may be integrally formed on the surface of the display unit 13. In this case, various inputs can be performed by touching the surface of the display unit 13 too, namely, by touch operations with a stylus pen, a finger tip or the like (not shown).

The display unit 13 displays, for example, finger images obtained by photographing printing fingers U1, nail region images (nail images) showing nails T in the finger images, nail designs (print images) to be printed on the nails T of printing fingers U1, thumbnail images for design check, various instruction screens, and the like thereon. Contents displayed on the display unit 13 during printing are described below.

Figure 7:
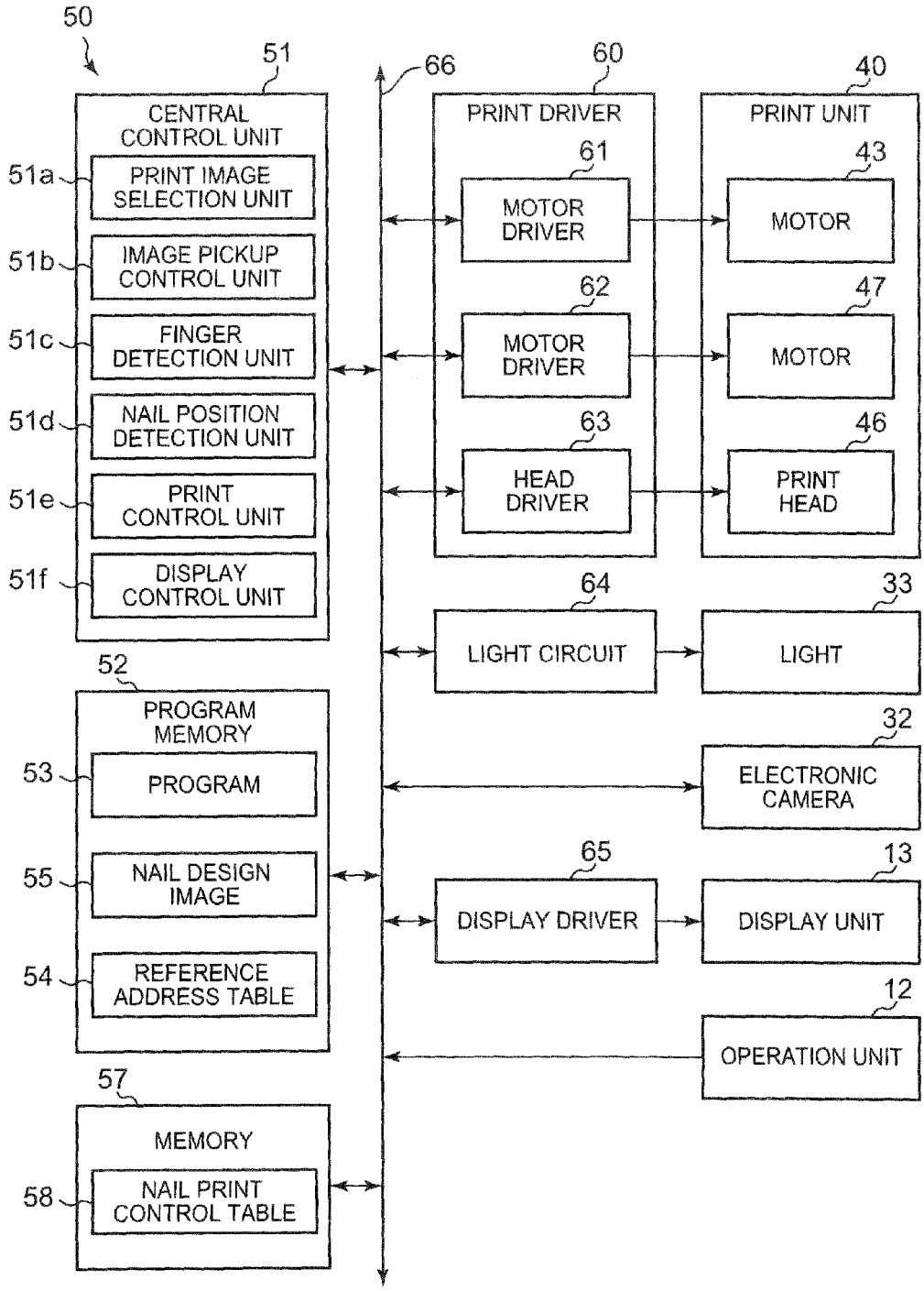
FIG. 7 is a block diagram showing a control configuration of the nail print apparatus in accordance with a first embodiment of the present invention.

The control device 50 is disposed, for example, on the substrate 31, which is disposed on the upper machine casing 11*b*. FIG. 7 is a block diagram showing a control configuration in the embodiment.

As shown in FIG. 7, the control device 50 includes a central control unit 51, a program memory 52, a memory 57, a print driver 60, a light circuit 64, a display driver 65, and a bus line 66. The print driver 60 includes a motor driver 61, a motor driver 62, and a head driver 63.

The central control unit 51, the program memory 52, the memory 57, the motor driver 61, the motor driver 62, the head driver 63, the light circuit 64, the electronic camera 32, the display driver 65, and the operation unit 12 are connected to the bus line 66. The bus line 66 makes the central control unit 51, the program memory 52, the memory 57, the motor driver 61, the motor driver 62, the head driver 63, the light circuit 64, the electronic camera 32, the display driver 65, and the operation unit 12 transfer data and signals to/from each other.

The motor driver 61 drives the motor 43 in accordance with instructions from the central control unit 51. The motor driver 62 drives the motor 47 in accordance with instructions from the central control unit 51. The head driver 63 drives the print head 46 in accordance with instructions from the central control unit 51. The light circuit 64 turns on/off and adjusts the lights 33 in accordance with instructions from the central control unit 51. The display driver 65 drives the display unit 13 in accordance with instructions from the central control unit 51.

In the program memory 52, a program 53 and data related to functions of the nail print apparatus 1 and the like are stored. The program 53 is a program readable by the central control unit 51.

In addition, in the program memory 52, a reference address table 54 is stored. In the reference address table 54, the X coordinate and the Y coordinate of the origin position (Xo, Yo) correlated with each other are stored.

In addition, in the program memory 52, a plurality of nail design images 55 is stored. The nail design images 55 are images printed on the nails T of printing fingers U1. The nail design images 55 may be stored in an external storage medium (a semiconductor memory or a hard disk drive, for example). In this case, when a reader/writer is connected to the bus line 66, and the external storage medium is attached to the reader/writer, the nail design images 55 stored in the external storage medium can be read by the reader/writer.

The memory 57 is used as a working memory for the central control unit 51 or the like.

For example, a nail print control table 58 shown in FIG. 8 is stored in the memory 57 by the central control unit 51. FIG. 8 shows the nail print control table 58 which is stored in the memory 57 in a case where printing is performed on the nails T (nails Ta, Tb, Tc and Td in FIG. 6, for example) of printing fingers U1 (four fingers, a little finger, a ring finger, a middle finger and an index finger, for example) as shown in FIG. 6. In the nail print control table 58, an identification number storage region 58*a*, a print status storage region 58*b*, an X coordinate storage region 58*c*, a Y coordinate storage region 58*d*, and a nail design image address storage region 58*e* correlated with each other are stored. The identification number storage region 58*a* is a region to store numbers used to identify the nails T (nails Ta, Tb, Tc and Td in FIG. 6, for example) of printing fingers U1. The print status storage region 58*b* is a region to store print statuses ("not yet", "in progress", and "done") of the nails T of printing fingers U1. The X coordinate storage region 58*c* is a region to store X coordinates of positions of the nails T of printing fingers U1. The Y coordinate storage region 58*d* is a region to store Y coordinates of positions of the nails T of printing fingers U1. The nail design image address storage region 58*e* is a region to store addresses of nail design images 55 to be printed on the nails T of printing fingers U1. The print statuses of the nails T of printing fingers U1 stored in the print status storage region 58*b* are appropriately rewritten by the central control unit 51 in accordance with the progress of printing.

The central control unit 51 shown in FIG. 7 includes a CPU which controls the components of the nail print apparatus 1. The program 53 allows the central control unit 51 to have various functions, so that the central control unit 51 performs various types of processing in accordance with the program 53. More specifically, the program 53 makes the central control unit 51 function as a print image selection unit 51*a*, an image pickup control unit (i.e. a photography control unit) 51*b*, a finger detection unit 51*c*, a nail position detection unit 51*d*, a print control unit 51*e*, and a display control unit 51*f*.

The print image selection unit 51*a* selects an image to be printed from among the plurality of nail design images 55 stored in the program memory 52 in accordance with an operation signal outputted from the operation unit 12. The print image selection unit 51*a* stores the address of the selected nail design image 55 in the nail design image address storage region 58*e* of the nail print control table 58.

The image pickup control unit 51 makes the electronic camera 32 pick up images, and obtains the images picked up by the electronic camera 32.

The finger detection unit 51*c* detects the number of printing fingers U1 inserted into the printing finger insertion unit 20*a* from the picked-up images obtained by the image pickup control unit 51*b*. More specifically, the finger detection unit 51*c* performs image processing, such as edge detection processing, on the picked-up images obtained by the image pickup control unit 51*b* to recognize finger images included in the picked-up images, and counts the number of the finger images.

The nail position detection unit 51*d* detects the reference positions (shown in FIG. 6) of the nails T of printing fingers U1 inserted into the printing finger insertion unit 20*a* from the picked-up images obtained by the image pickup control unit 51*b*. More specifically, the nail position detection unit 51*d* performs image processing, such as edge detection processing, on the picked-up images obtained by the image pickup control unit 51*b* to recognize nail images included in the picked-up images, and detects positions of the nail images on the picked-up images. Then, the nail position detection unit 51*d* converts the positions of the nail images into the reference positions of the nails T in the XY Cartesian coordinate system. The nail position detection unit 51*d* stores X coordinates of the reference positions of the detected nails T in the X coordinate storage region 58*c* of the nail print control table 58, and stores Y coordinates thereof in the Y coordinate storage region 58*d* of the nail print control table 58. (Refer to FIG. 8.)

The print control unit 51*e* controls the print, unit 40 (the motor 43, the motor 47 and the print head 46) via the print driver 60 (the motor driver 61, the motor driver 62 and the head driver 63), so as to make the print unit 40 perform printing on the nails T of printing fingers U1 successively.

The display control unit 51*f* controls the display unit 13 via the display driver 65, so as to make the display unit 13 display various images thereon. For example, the display control unit 51*f* distinguishes, in finger images respectively corresponding to printing fingers U1, between a finger image corresponding to a printing finger U1 having the nail T under printing (under-printing fingernail T) performed by the print head 46 of the print unit 40 and finger images corresponding to printing fingers U1 having the nails T not under printing (not-under-printing fingernails T) performed thereby, so as to display the finger images on the display unit 13.

Figure 9:
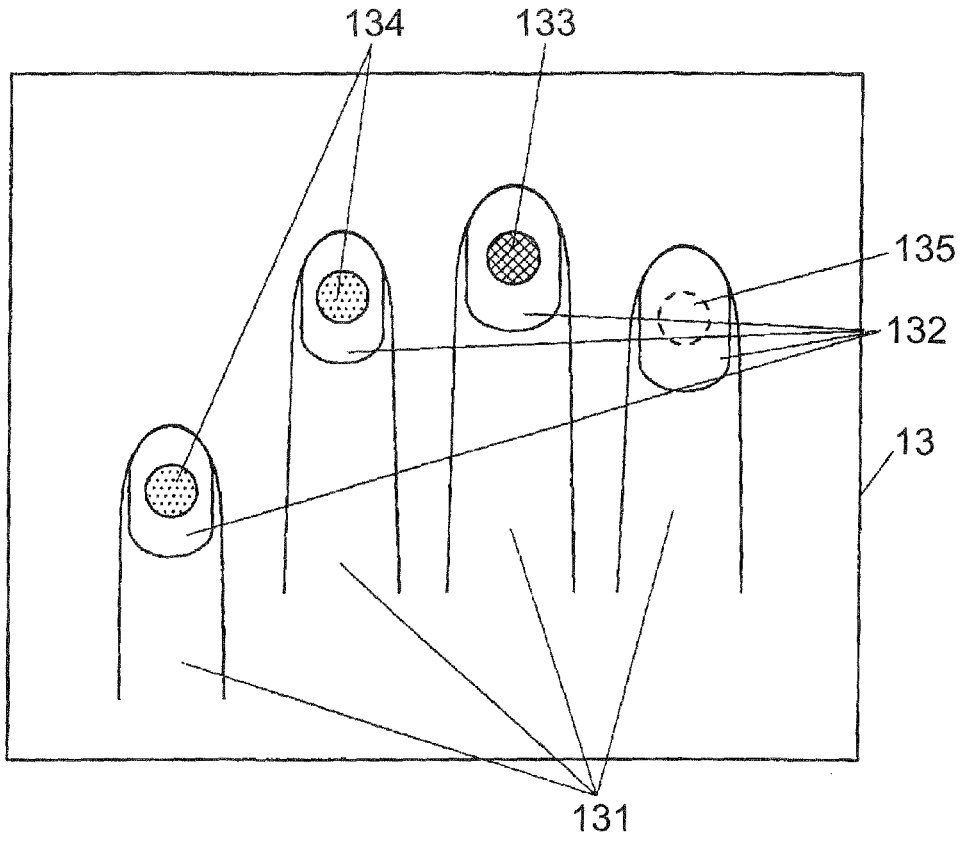
FIG. 9 shows an example of a display screen.
Figure 10:
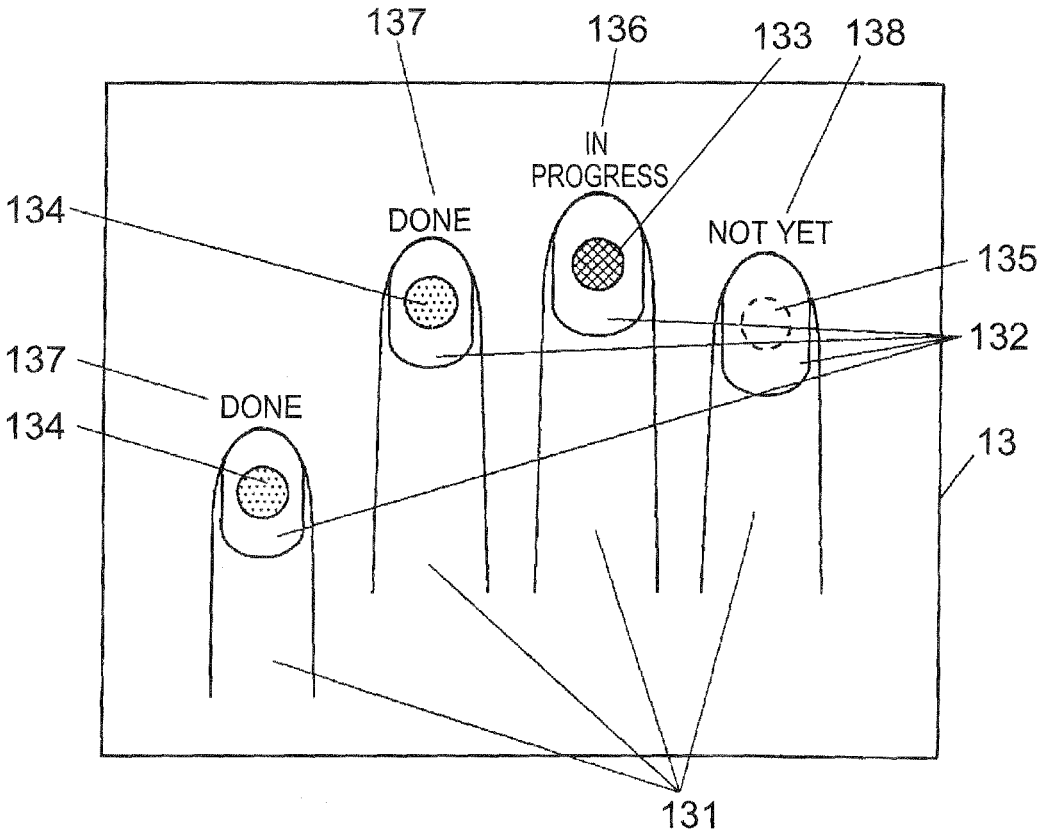
FIG. 10 shows another example of the display screen.
Figure 11:
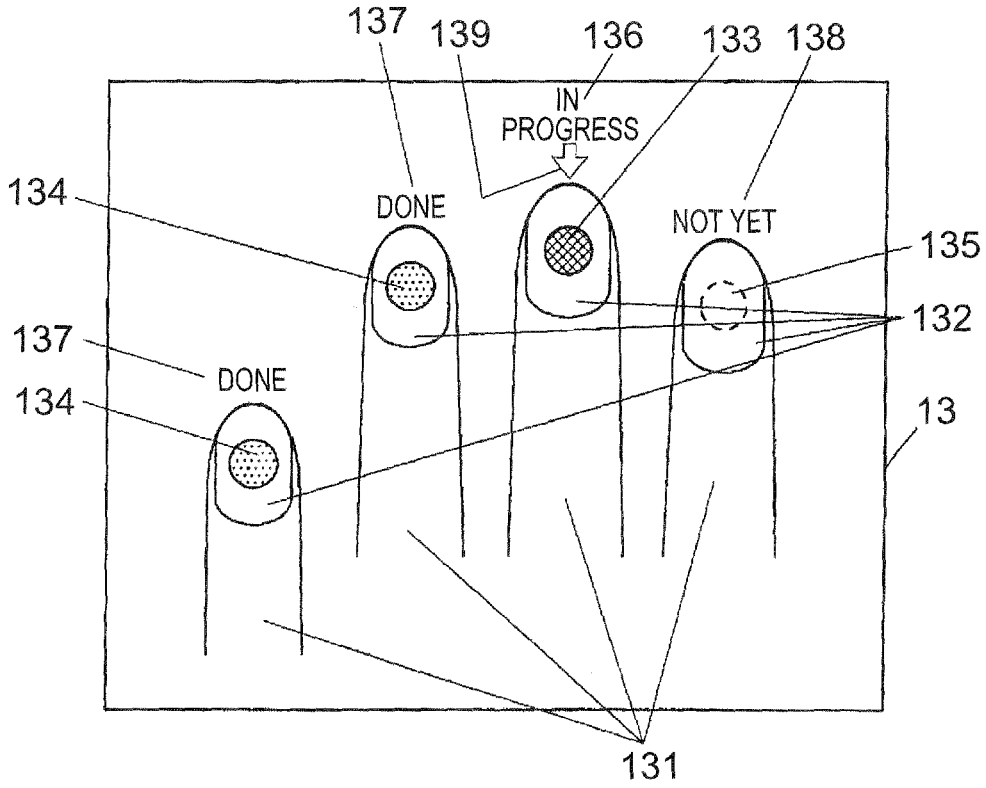
FIG. 11 shows another example of the display screen.

FIGS. 9 to 11 show examples of images displayed on the display unit 13 under the control of the display control unit 51*f*.

As shown in FIGS. 9 to 11, the image displayed on the display unit 13 includes finger images 131. The number of finger images 131 is the same as the number of printing fingers U1 detected by the finger detection unit 51*c*. The finger images 131 are displayed side by side. Each finger image 131 includes a nail image 132. The finger images 131 respectively correspond to the printing fingers U1, and are respectively correlated with the identification numbers.

The finger images 131 are displayed on the display unit 13 in such a way that the finger image 131 correlated with the under-printing fingernail T is distinguished from the finger images 131 respectively correlated with the not-under-printing fingernails T. It is preferable to classify the not-under-printing fingernails T into the not-under-printing fingernails T on which printing has already been performed (already-printed fingernails T) and the not-under-printing fingernails T on which printing has not been performed yet (not-yet-printed fingernails T). That is, it is preferable that the finger images 131 be displayed in such a way that the finger image 131 correlated with the under-printing fingernail T, the finger images 131 correlated with the already-printed fingernails T, and the finger images 131 correlated with the not-yet-printed fingernails T are distinguished from each other. Thus, the nail print apparatus 1 in the embodiment includes the display unit 13 which displays the under-printing fingernail T and the not-under-printing fingernails T thereon in such a way that a user having fingernails T on which printing is performed by the print head 46 of the print unit 40 can distinguish between the under-printing fingernail T and the not-under-printing fingernails T.

As a method for displaying fingernails T on the display unit 13 in such a way as to distinguish the under-printing fingernail T from the not-under-printing fingernails T, for example, attaching marks to the nail images 132 of the finger images 131 can be used as a display mode.

That is, for example, as shown in FIG. 9, a mark 133 is attached to the nail image 132 of the finger image 131 correlated with the under-printing fingernail T, marks 134 are attached the nail images 132 of the finger images 131 correlated with the already-printed fingernails T, and a mark 135 is attached to the nail image 132 of the finger image 131 correlated with the not-yet-printed fingernail T. Colors or the like of the marks 133, 134 and 135 are different from each other. More specifically, the mark 133 is red, the mark 134 is blue, and the mark 135 is grey with the outline shown by a broken line. The mark 133 denotes that a fingernail is under printing, the mark 134 denotes that a fingernail has already undergone printing, and the mark 135 denotes that a fingernail has not undergone printing yet. The colors, shapes and the like of the marks 133 to 135 are examples. Hence, as long as the marks 133 to 135 are display modes with which the fingernails T can be distinguished from each other, their display modes are not limited thereto. However, if a print image and a mark are similar in color, it is difficult to visually confirm them. Hence, the colors of a mark and a print image may be complementary colors, which are a pair of colors being of opposite hue, located opposite in color circle. For example, when one of a mark and a print image is red, the other is green, when one thereof is orange, the other is blue, when one thereof is yellow, the other is purple, or the like. Furthermore, a mark may blink in red and white, blue and white, or the like to increase visibility of the mark. Furthermore, the marks 133 to 135 may be formed only by lines, such as a double circle shown by solid lines, a circle shown by a solid line, and a circle shown by a broken line, respectively, and the under-printing fingernail T may be distinguished from the not-under-printing fingernails T by the types, colors and/or numbers of lines, for example. (Refer to FIG. 21, for example.)

In order not to move or shift the printing finger U1 having the nail T under printing, it is most important to inform a user which printing finger U1 is the printing finger U1 having the nail T currently under printing (under-printing fingernail T). Then, it is possible to attach the mark 133 to the nail image 132 of the finger image 131 correlated with the under-printing fingernail T, and not to attach any marks to the other nail images 132 of the finger images 131 correlated with the not-under-printing fingernails T. Furthermore, the regions where the marks 133 to 135 are attached are not limited to fingernails. As long as a user can know which fingernail is under printing and which fingernail is not under printing, the regions where the marks 133 to 135 are attached may be regions other than fingernails, for example, fingers.

Furthermore, the method for displaying fingernails T on the display unit 13 in such a way as to distinguish the under-printing fingernail T from the not-under-printing fingernails T is not limited to using the marks 133 to 135.

For example, in FIG. 10, a wording 136 "in progress" is attached to the finger image 131 correlated with the under-printing fingernail T, wordings 137 "done" are attached to the finger images 131 correlated with the already-printed fingernails T, and a wording 138 "not yet" is attached to the finger image 131 correlated with the not-yet-printed fingernail T as a display mode. The wording 136 denotes that a fingernail is under printing, the wording 137 denotes that a fingernail has already undergone printing, and the wording 138 denotes that a fingernail has not undergone printing yet. In FIG. 10, in addition to the wordings 136 to 138, the marks 133 to 135 which are the same as those shown in FIG. 9 are attached to the nail images 132 of the finger images 131. However, in this case, it is not necessary to attach the marks 133 to 135 to the nail images 132 thereof. Alternatively, it is possible to attach the wording 136 to the finger image 131 correlated with the under-printing fingernail T, and not to attach any wordings to the other finger images 131 correlated with the not-under-printing fingernails T.

Furthermore, for example, as shown in FIG. 11, it is possible to attach an arrow 139 to the finger image 131 correlated with the under-printing fingernail T, and not to attach the arrow 139 to the other finger images 131, as a display mode. In this case, the arrow 139 denotes that a fingernail is under printing. In other words, the arrow 139 denotes that the nail T of a printing finger U1 corresponding to the finger image 131 indicated by the arrow 139 is under printing. In FIG. 11, in addition to the arrow 139, the marks 133 to 135 and the wordings 136 to 138 which are the same as those shown in FIG. 10 are attached to the finger images 131. However, in this case, it is not necessary to attach the marks 133 to 135 and the wordings 136 to 138 to the finger images 131.

Furthermore, although not being shown, for example, the finger image 131 correlated with the under-printing fingernail T may be displayed in such a way as to blink (a blink display mode), and the finger images 131 correlated with the not-under-printing fingernails T may keep being displayed (a continuous display mode), or the other way around.

Furthermore, the finger image 131 correlated with the under-printing fingernail T may be displayed in such a way as to be semi-transparent (a semi-transparent display mode). Alternatively, the finger images 131 correlated with the not-under-printing fingernails T may be displayed in the semi-transparent display mode. In the semi-transparent display mode, the pixel value of each pixel of a finger image 131 is an average value of the pixel value of its corresponding pixel of the finger image 131 displayed in such a way as to be non-transparent (a non-transparent display mode) and the pixel value of its corresponding pixel of the background.

Furthermore, different colors may be used for the finger image 131 correlated with the under-printing fingernail T and the finger images 131 correlated with the not-under-printing fingernails T.

Furthermore, it is possible to combine print, images (nail design images) to be printed with the nail images 132 of the fingernails T in such a way as to lay a non-transparent print image on the nail image 132 corresponding to the already-printed fingernail T so as to display the nail image 132 having the non-transparent print image thereon, to lay a non-transparent/semi-transparent print image on the nail image 132 corresponding to the under-printing fingernail T so as to display the nail image 132 having the non-transparent/semi-transparent print image thereon, and to lay a semi-transparent print image on the nail image 132 corresponding to the not-yet-printed fingernail T so as to display the nail image 132 having the semi-transparent print image thereon. The non-transparent/semi-transparent print image is laid and displayed on the nail image 132 corresponding to the under-printing fingernail T in such a way that a part already printed is non-transparent and a part to be printed hereafter is semi-transparent. The non-transparent/semi-transparent print image may be configured to change in such a way that the semi-transparent part decreases and the non-transparent part increases gradually, reflecting the progress of printing on the under-printing fingernail T, appropriately.

Alternatively, it is possible to combine a print image (nail design image) to be printed only with the nail image 132 corresponding to the already-printed fingernail T so as to display the nail image 132 having the print image thereon, and accordingly so as to display the nail image 132 corresponding to the under-printing fingernail T and the nail image 132 corresponding to the not-yet-printed fingernail T having no print image thereon.

Figure 12:
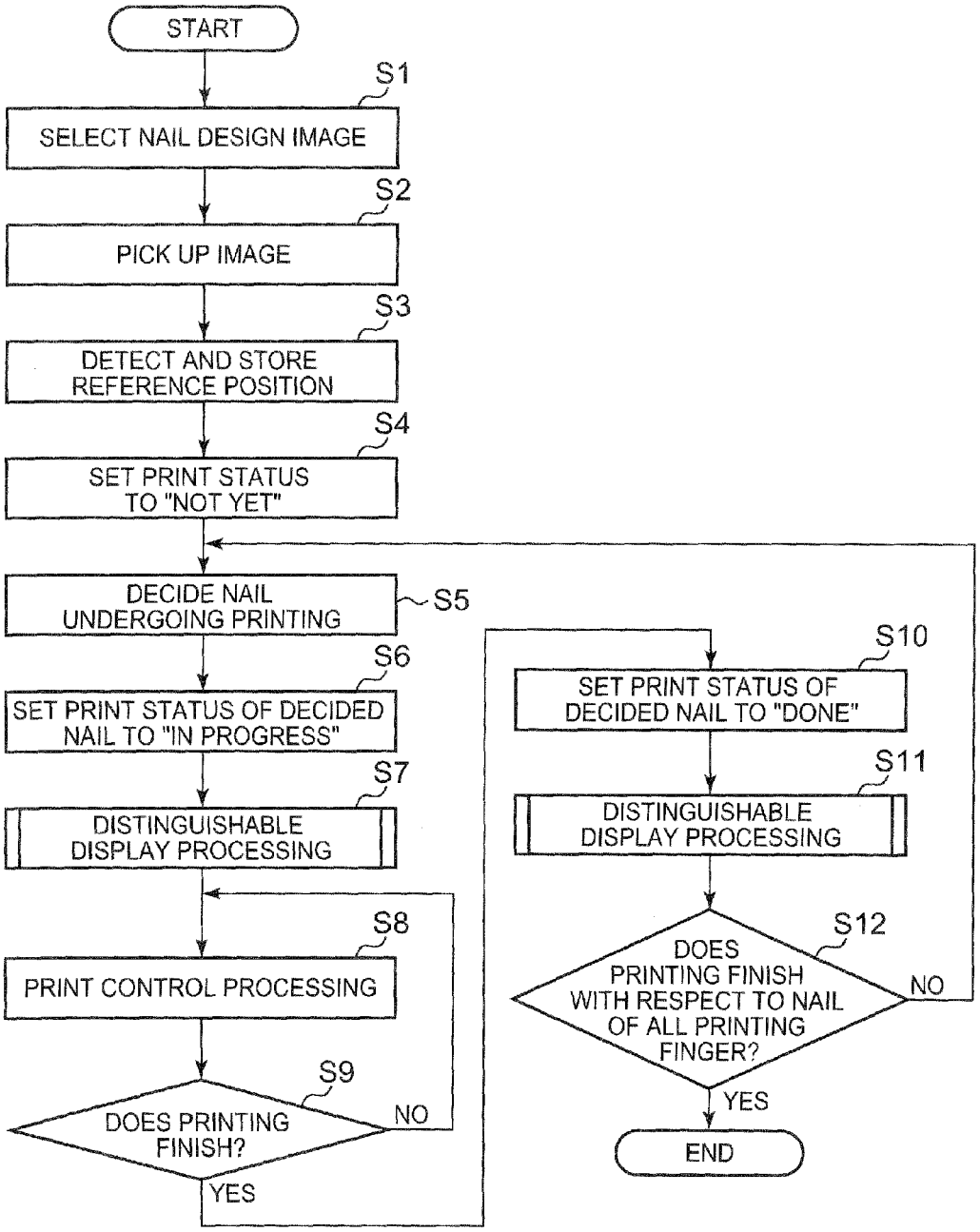
FIG. 12 is a flowchart showing processing performed by a control unit of the nail print apparatus in accordance with the first embodiment.
Figure 13:
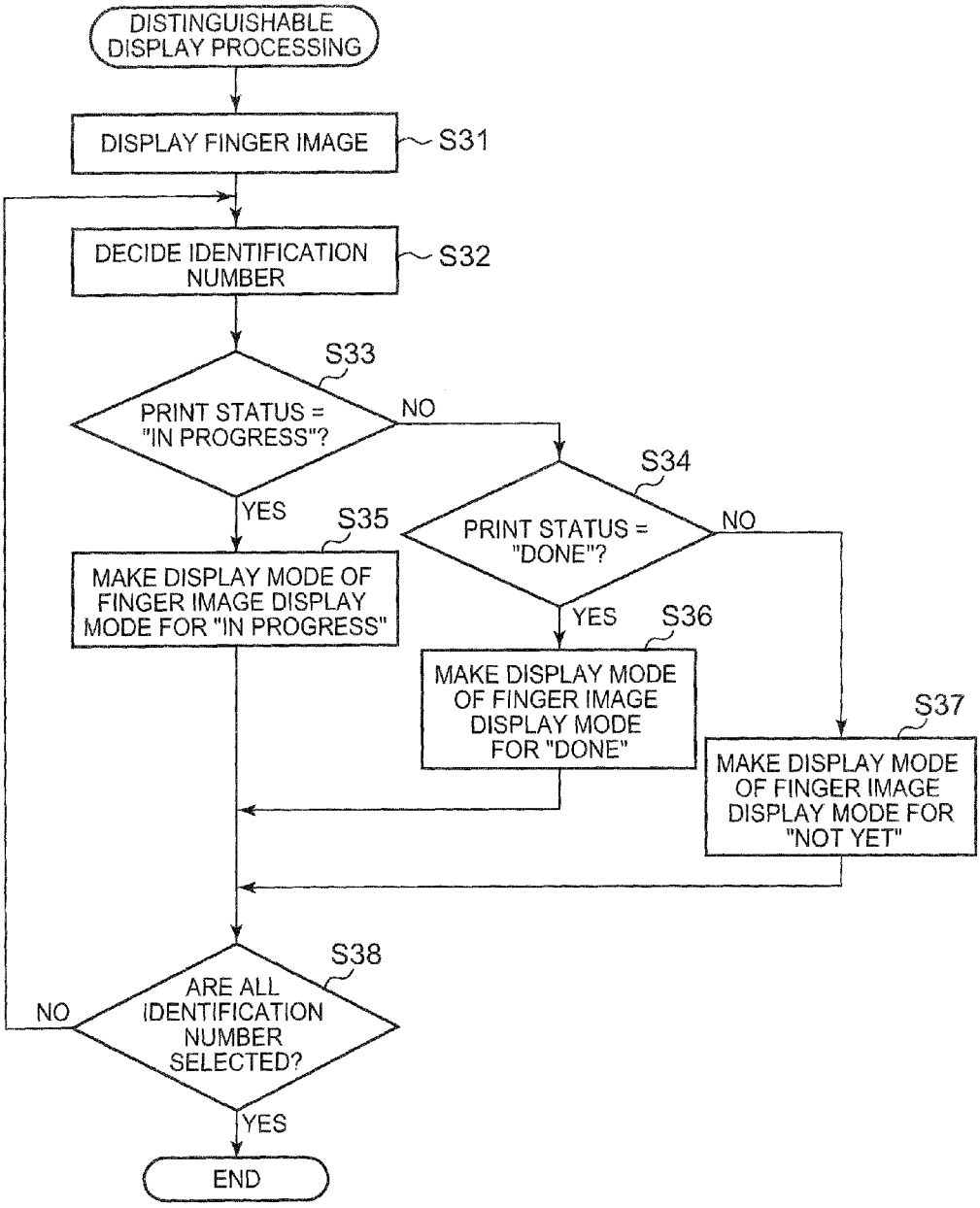
FIG. 13 is a flowchart showing processing performed by the control unit of the nail print apparatus in accordance with the first embodiment.

Next, referring to FIGS. 12 and 13, processing performed by the central control unit 51 in accordance with the program 53 is described, and also operation of the nail print apparatus 1 based on the processing performed by the central control unit 51 is described.

In order to perform printing with the nail print apparatus 1, a user first presses the power button 120 to start the control device 50, and chooses a nail design image which the user desires to print on the nail T of a printing finger U1 with the setting button 121 and the decision button 122 (Step S1). A nail design image is chosen for each printing finger U1.

More specifically, by the program 53 making the central control unit 51 function as the print image selection unit 51*a*, the central control unit 51 displays thumbnail images of the nail design images 55 stored in the program memory 52 on the display unit 13. Then, a user operates the setting button 121 so that a thumbnail image is selected from among the thumbnail images displayed on the display unit 13, and then presses the decision button 122. Then, the central control unit 51 generates the nail print control table 58 shown in FIG. 7 in the memory 57, correlates the address of the selected nail design image 55 with an identification number, and stores the address thereof in the nail design image address storage region 58*e* of the nail print control table 58. By the central control unit 51 repeating these, nail design images are selected successively, and the addresses of the selected nail design images 55 are respectively correlated with the identification numbers successively. In a case where the same nail design image is printed on the nails T of all the printing fingers U1, the nail design image may be selected for all the printing fingers U1 when a user performs a choice operation one time. In this case, when one nail design image 55 is selected, the address of the selected nail design image 55 is correlated with the identification numbers of the nails T of all the printing fingers U1.

Then, the user inserts printing fingers U1 (for example, the index finger, the middle finger, the ring finger and the little finger) of his/her right hand or left hand into the printing finger insertion unit 20*a*, and places the printing fingers U1 on the printing finger placement surface (the upper surface of the partition 21) with the nails T of the printing fingers U1 facing upward.

Next, when the user presses the print button 123, the print button 123 outputs an operation signal corresponding thereto to the central control unit 51. Then, the program 53 makes the central control unit 51 function as the image pickup control unit 51*b*. Consequently, the central control unit 51 turns on the lights 33, and makes the electronic camera 32 perform image pickup operations (Step S2). When the electronic camera 32 performs the image pickup operations, the electronic camera 32 outputs picked-up images including finger images and nail images, and the central control unit 51 obtains the picked-up images.

Next, the program 53 makes the central control unit 51 function as the finger detection unit 51*c*. Consequently, the central control unit 51 detects the number of printing fingers U1 on the basis of the picked-up images, and stores the detected number of printing fingers U1 in the memory 57.

Furthermore, the program 53 makes the central control unit 51 function as the nail position detection unit 51*d*. Consequently, as shown in FIG. 6, the central control unit 51 detects the reference positions (Xa, Ya) (Xb, Yb), (Xc, Yc) and (Xd, Yd) of the nails T (nails Ta, Tb, Tc and Td) of the printing fingers U1 on the basis of the picked-up images. Then, the central control unit 51 correlates the X coordinates of the detected reference positions (Xa, Ya), (Xb, Yb), (Xc, Yc) and (Xd, Yd) with the identification numbers, respectively, and stores the X coordinates in the X coordinate storage region 58*c*, and also correlates the Y coordinates of the detected reference positions (Xa, Ya), (Xb, Yb), (Xc, Yc) and (Xd, Yd) with the identification numbers, respectively, and stores the Y coordinates in the Y coordinate storage region 58*d* (Step S3).

Next, the central control unit 51 sets a print status correlated with all the identification numbers to "not yet" (Step S4). More specifically, the central control unit 51 correlates the print status "not yet" with all the identification numbers, and stores the print status in the print status storage region 58*b*.

Next, the central control unit 51 selects a printing finger U1 from among the printing fingers U1 so as to decide to perform printing on the nail T of the printing finger U1 (Step S5). More specifically, the central control unit 51 selects an identification number from the nail print control table 58.

Next, the central control unit 51 sets the print status correlated with the printing finger U1 having the nail T decided to undergo printing to "in progress" (Step S6). More specifically, the central control unit 51 changes the print status correlated with the identification number selected at Step S5 from "not yet" to "in progress", and stores the print status "in progress" in the print status storage region 58*b*.

Next, the program 53 makes the central control unit 51 function as the display control unit 51*f*. Consequently, the central control unit 51 performs distinguishable display processing (Step S7). By the central control unit 51 performing the distinguishable display processing, the image shown in FIG. 9, 10 or 11 is displayed on the display unit 13. The image displayed by the central control unit 51 performing the distinguishable display processing keeps being displayed during print control processing (Step S8) described below.

Referring to FIG. 13, the distinguishable display processing is described.

First, the central control unit 51 displays finger images 131, the number of which is the same as the number of the printing fingers U1 detected at Step S3, on the display unit 13 via the display driver 65 (Step S31).

Next, the central control unit 51 selects an identification number from the nail print control table 58 (Step S32).

Next, the central control unit 51 determines which of the print statuses "in progress", "done", and "not yet" is correlated with the identification number selected at Step S32 (Steps S33 and S34).

When determining that the print status correlated with the identification number selected at Step S32 is "in progress" (Step S33; YES), the central control unit 51 makes the display mode of the finger image 131 correlated with the identification number a display mode for "in progress" (Step S35). For example, the central control unit 51 attaches at least one of the mark 133, the wording 136, and the arrow 139 which denote that a fingernail is under printing, namely "in progress", to the finger image 131 correlated with the selected identification number, so as to display the finger image 131 with the selected mark 133, wording 136, and/or arrow 139 on the display unit 13. The finger image 131 correlated with the selected identification number may be displayed in the blink display mode, the continuous display mode, the semi-transparent display mode or the non-transparent display mode. Furthermore, the print status "in progress" may be shown by combining a print image, which is a nail design image to be printed, with a nail image 132 included in the finger image 131 in such a way as to display, of the print image, a part which has already been printed in the non-transparent display mode and a part which has not been printed yet in the semi-transparent display mode on the nail image 132.

When determining that the print status correlated with the identification number selected at Step S32 is "done" (Step S33; NO and Step S34; YES), the central control unit 51 makes the display mode of the finger image 131 correlated with the identification number a display mode for "done" (Step S36). For example, the central control unit 51 attaches at least one of the mark 134 and the wording 137 which denote that a fingernail has already undergone printing, namely "done", to the finger image 131 correlated with the selected identification number, so as to display the finger image 131 with the selected mark 134 and/or wording 137 on the display unit 13. The finger image 131 correlated with the selected identification number may be displayed in the blink display mode (in the case of the continuous display mode at Step S35), the continuous display mode (in the case of the blink display mode at Step S35), the semi-transparent display mode (in the case of the non-transparent display mode at Step S35) or the non-transparent display mode (in the case of the semi-transparent display mode at Step S35). Furthermore, the print status "done" may be shown by combining a print image, which is a nail design image to be printed, with a nail image 132 included in the finger image 131 in such a way as to display the print image in the non-transparent display mode on the nail image 132.

When determining that the print status correlated with the identification number selected at Step S32 is "not yet" (Step S33; NO and Step S34; NO), the central control unit 51 makes the display mode of the finger image 131 correlated with the identification number a display mode for "not yet" (Step S36). For example, the central control unit 51 attaches at least one of the mark 135 and the wording 138 which denote that a fingernail has not undergone printing yet, namely "not yet", to the finger image 131 correlated with the selected identification number, so as to display the finger image 131 with the selected mark 135 and/or wording 138 on the display unit 13. The finger image 131 correlated with the selected identification number may be displayed in the blink display mode (in the case of the continuous display mode at Step S35), the continuous display mode (in the case of the blink display mode at Step S35), the semi-transparent display mode (in the case of the non-transparent display mode at Step S35) or the non-transparent display mode (in the case of the semi-transparent display mode at Step S35). Furthermore, the print status "not yet" may be shown by combining a print image, which is a nail design image to be printed, with a nail image 132 included in the finger image 131 in such a way as to display the print image in the semi-transparent display mode on the nail image 132.

The central control unit 51 repeats the selection (Step S32), the determination (Steps S33 and S34), and the display control (Steps S35 to S37) (Step S38; NO). That is, the central control unit 51 selects the identification numbers from the nail print control table 58 successively, determines the print status correlated with each selected identification number, and makes the display mode of the finger image 131 correlated with the selected identification number a display mode in accordance with the determination result. When the selection (Step S32) the determination (Steps S34 and S35), and the display control (Steps S35 to S37) finish with respect to all the identification numbers (Step S38; YES), the central control unit 51 ends the distinguishable display processing shown in FIG. 13.

As shown in FIG. 12, after the distinguishable display processing, the program 53 makes the central control unit 51 function as the print control unit 51*e*. Consequently, the central control unit 51 controls the print unit 40 via the print driver 60, so as to make the print head 46 perform printing operations (the print control processing at Step S8). Consequently, the print head 46 of the print unit 40 performs printing on the nail T decided to undergo printing.

More specifically, the central control unit 51 controls the motors 43 and 47 via the motor drivers 61 and 62 on the basis of the X coordinate and the Y coordinate correlated with the identification number selected at Step S5. Consequently, the print head 46 moves in the X direction and the Y direction over the nail T decided to undergo printing. In addition, while the print head 46 is moving, the central control unit 51 reads a nail design image 55 in accordance with a nail design image's address correlated with the identification number selected at Step S5, and also controls the print head 46 via the head driver 63 on the basis of the nail design image 55. Consequently, the print head 46 repeatedly discharges ink to the nail T decided to undergo printing, so that an image in accordance with the nail design image 55 is formed on the nail T decided to undergo printing.

When determining that the printing on the nail T decided to undergo printing finishes (Step S9; YES), the central control unit 51 sets the print status correlated with the printing finger U1 having the nail T to "done" (Step S10). More specifically, the central control unit 51 changes the print status correlated with the identification number selected at Step S5 from "in progress" to "done", and stores the print status "done" in the print status storage region 58*b*.

Next, the central control unit 51 performs the distinguishable display processing (Step S11). The distinguishable display processing at Step S11 is the same as that at Step 97. By the central control unit 51 performing the distinguishable display processing, the finger image 131 displayed in the display mode for "in progress" is displayed in the display mode for "done".

The central control unit 51 determines whether or not the printing finishes with respect to the nails T of all the printing fingers U1 inserted into the printing finger insertion unit 20*a* (Step 912). While not determining that the printing finishes with respect to the nails T of all the printing fingers U1 (Step S12; NO), the central control unit 51 repeats Steps S5 to S11. Consequently, the print head 46 of the print unit 40 performs printing on the nails T of the printing fingers U1 inserted into the printing finger insertion unit 20*a* successively, and the finger image 131 correlated with the under-printing fingernail T (the identification number selected at Step S5) is displayed to be distinguished from the other finger images 131 on the display unit 13. When determining that the printing finishes with respect to the nails T of all the printing fingers U1, namely, when determining that Steps S5 to S11 finish with respect to all the identification numbers (Step S12; YES), the central control unit 51 ends the processing shown in FIG. 12.

As described above, according to the nail print apparatus 1 in the embodiment, the finger image 131 for the under-printing fingernail T is displayed to be distinguished from the finger images 131 for the not-under-printing fingernails T. Accordingly, a user can recognize, of the nails T of the printing fingers U1 inserted into the printing finger insertion unit 20*a*, which nail T is under printing and which nail T is not under printing. Accordingly, the user can move the printing fingers U1 having the not-under-printing fingernails T. Because the user does not need to keep the printing fingers U1 having the not-under-printing fingernails T still, the user feels comfortable.

More specifically, for example, in the case where, under the control of the display control unit 51*f*, the mark 133 is attached to the finger image 131 of the printing finger U1 having the under-printing fingernail T, the printing being performed by the print head 46, and the finger image 131 with the mark 133 is displayed on the display unit 13; and/or the marks 134 and/or 135, which are different from the mark 133 attached to the finger image 131 of the printing finger U1 having the under-printing fingernail T, are attached to the finger images 131 of the printing fingers U1 having the not-under-printing fingernails T, and the finger images 131 with the marks 134 and/or 135 are displayed on the display unit 13, a user can instinctively/readily recognize, of the nails T of the printing fingers U1 inserted into the printing finger insertion unit 20*a*, which nail T is under printing and which nail T is not under printing.

Furthermore, in the case where, under the control of the display control unit 51*f*, the wording 136 ("in progress", for example) is attached to the finger image 131 of the printing finger U1 having the under-printing fingernail T, the printing being performed by the print head 46, and the finger image 131 with the wording 136 is displayed on the display unit 13; and/or the wordings 137 and/or 138 ("done" and "not yet", for example), which are different from the wording 136 attached to the finger image 131 of the printing finger U1 having the under-printing fingernail T, are attached to the finger images 131 of the printing fingers U1 having the not-under-printing fingernails T, and the finger images 131 with the wordings 137 and/or 138 are displayed on the display unit 13, a user can certainly recognize, of the nails T of the printing fingers U1 inserted into the printing finger insertion unit 20*a*, which nail T is under printing and which nail T is not under printing.

Furthermore, in the case where, under the control of the display control unit 51*f*, the arrow 139 is attached to the finger image 131 of the printing finger U1 having the under-printing fingernail T, the printing being performed by the print head 46, and the finger image 131 with the arrow 139 is displayed on the display unit 13, a user can visually and certainly recognize the finger (printing finger U1) having the under-printing fingernail T.

Furthermore, in the case where, under the control of the display control unit 51*f*, one of the finger image 131 of the printing finger U1 having the under-printing fingernail T, the printing being performed by the print head 46, and the finger images 131 of the printing fingers U1 having the not-under-printing fingernails T is displayed on the display unit 13 in the blink display mode, and the other thereof is displayed on the display unit 13 in the continuous display mode, a user can visually and certainly recognize the finger (printing finger U1) having the under-printing fingernail T.

Furthermore, in the case where, under the control of the display control unit 51*f*, one of the finger image 131 of the printing finger U1 having the under-printing fingernail T, the printing being performed by the print head 46, and the finger images 131 of the printing fingers U1 having the not-under-printing fingernails T is displayed on the display unit 13 in the semi-transparent display mode, and the other thereof is displayed on the display unit 13 in the non-transparent display mode, a user can visually and certainly recognize the finger (printing finger U1) having the under-printing fingernail T.

Furthermore, in the embodiment, of the finger images 131 of the printing fingers U1 having the not-under-printing fingernails T, the finger images 131 of the printing fingers U1 having the already-printed fingernails T and the finger images 131 of the printing fingers U1 having the not-yet-printed fingernails T are distinguished from each other, and displayed to be distinguished from each other on the display unit 13. Accordingly, a user can recognize not only which nail T is under printing and which nail T is not under printing, but also how many nails T have not undergone printing yet. Consequently, a user can estimate how much time is required to finish nail printing with respect to the nails T of all the printing fingers U1. Accordingly, the user can enjoy nail design processing (nail printing), feeling easy and comfortable, without feeling irritated.

Second Embodiment

Next, referring to FIGS. 14 to 17, a nail print apparatus in accordance with a second embodiment of the present invention is described. In the second embodiment, only the control configuration of the nail print apparatus 1 is different from the first embodiment. Hence, in the following, the different points from the first embodiment are described in particular.

Figure 14:
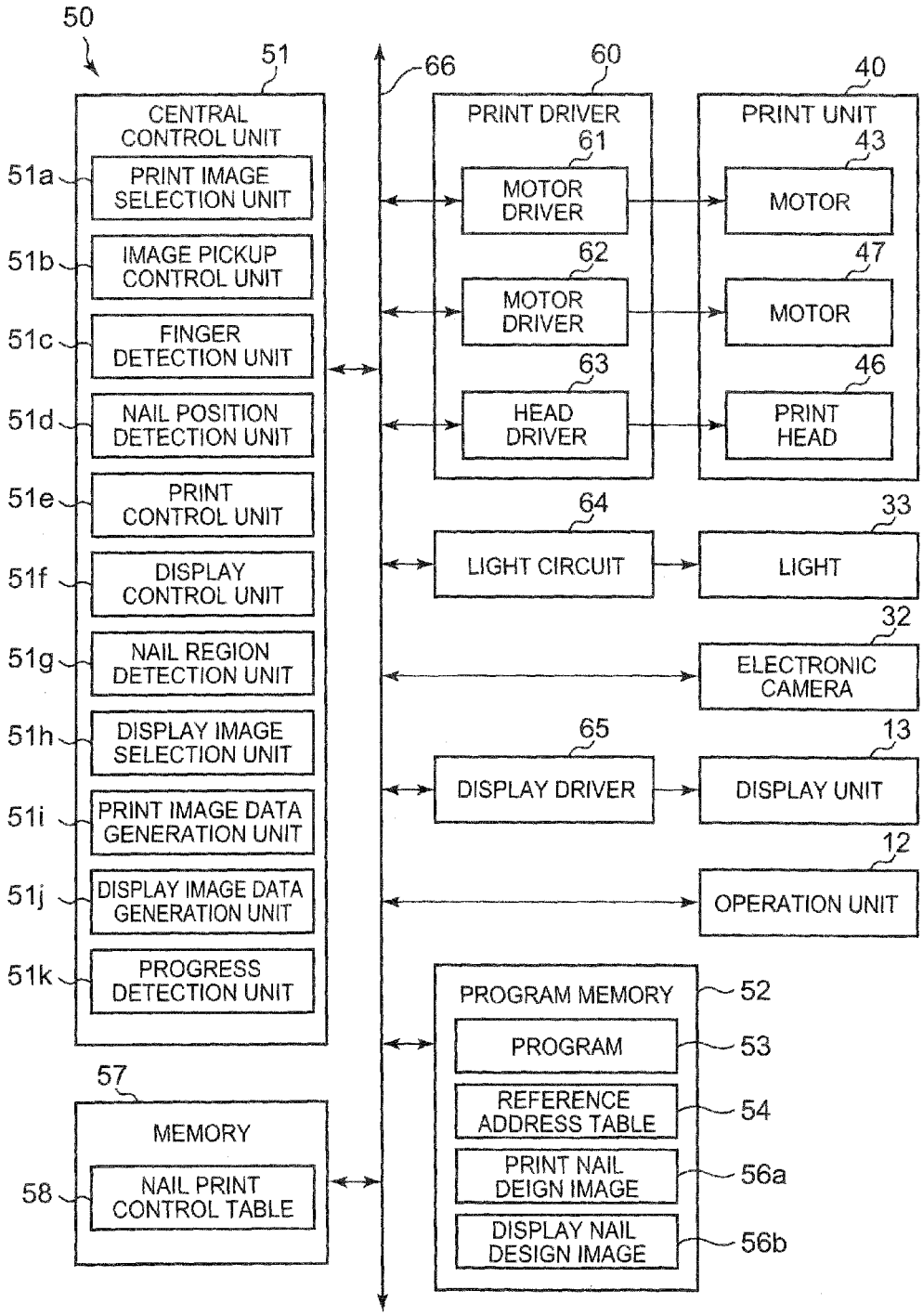
FIG. 14 is a block diagram showing a control configuration of a nail print apparatus in accordance with a second embodiment of the present invention.

FIG. 14 is a block diagram showing a control configuration of the nail print apparatus 1 in accordance with the second embodiment.

As shown in FIG. 14, in the program memory 52 of the nail print apparatus 1 in the second embodiment, like the first embodiment, the program 53 and data related to functions of the nail print apparatus 1, the reference address table 54, and the like are stored. In addition, the following data are stored therein.

That is, in the second embodiment, in the program memory 52, a plurality of nail design images 56*a* for printing (print nail design images 56*a*, hereinafter) is stored. The print nail design images 56*a* are images to be printed on the nails T of printing fingers U1.

In addition, in the program memory 52, a plurality of nail design images 56*b* for display (display nail design images 56*b*, hereinafter) is stored. The display nail design images 56*b* are images displayed on the display unit 13 during printing, and have the resolution and the number of pixels suitable for being displayed on the display unit 13. The print nail design images 56*a* and the display nail design images 56*b* have a one-to-one correspondence, so that the addresses of the print nail design images 56*a* and the addresses of their respective display nail design images 56 are correlated with each other. A print nail design image 56*a* and a display nail design image 56*b* correlated with the print nail design image 56*a* are the same, but have different resolutions and different numbers of pixels.

The print nail design images 56*a* and the display nail design images 56*b* may be stored in an external storage medium (a semiconductor memory or a hard disk drive, for example). In this case, when a reader/writer is connected to the bus line 66, and the external storage medium is attached to the reader/writer, the print nail design images 56*a* and the display nail design images 56*b* stored in the external storage medium can be read by the reader/writer.

In addition to the functions described in the first embodiment, the central control unit 51 of the nail print apparatus 1 in the second embodiment functions as a nail region detection unit 51*g*, a display image selection unit 51*h*, a print image data generation unit 51*i*, a display image data generation unit 51*j*, and a progress detection unit 51*k* by cooperating with the program 53.

The nail region detection unit 51*g* detects the sizes and, the extents of the nails T of printing fingers U1 inserted into the printing finger insertion unit 20*a* from picked-up images obtained by the image pickup control unit 51*b*. More specifically, the nail region detection unit 51*g* performs image processing, such as edge detection processing, on the picked-up images obtained by the image pickup control unit 51*b*, so as to recognize the nail regions and their respective edges included in the picked-up images, and detect positions of points on the edge of the nail region included in each picked-up image. Then, the nail region detection unit 51*g* converts the positions (coordinates) of the points on the edge of the nail region shown in the picked-up image's coordinate system into positions (coordinates) of points on the outline of the nail T shown in the XY Cartesian coordinate system.

The display image selection unit 51*h* selects a display nail design image 56*b* from among the display nail design images 56*b* stored in the program memory 52, the display nail design image 56*b* being correlated with a print nail design image 56*a* selected by the print image selection unit 51*a*.

The print image data generation unit 51*i* generates print image data from the print nail design image 56*a* selected by the print image selection unit 51*a*. That is, the print image data generation unit 51*i* performs coordinate conversion on the print nail design image 56*a* selected by the print image selection unit 51*a* to convert the coordinates of each pixel of the print nail design image 56*a* into coordinates in the XY Cartesian coordinate system. The print nail design image 56*a* after the coordinate conversion is referred to as print image data. The print image data is image data for the print head 46 to print a print image of a nail design on a nail T.

The display image data generation unit 51*j* generates display image data from the display nail design image 56*b* selected by the display image selection unit 51*h*. That is, the display image data generation unit 51*j* performs coordinate conversion on the display nail design image 56*b* selected by the display image selection unit 51*h* to convert the coordinates of each pixel of the display nail design image 56*b* into coordinates in the picked-up image's coordinate system. The display nail design image 56*b* after the coordinate conversion is referred to as display image data. The display image data corresponds to the print image data generated by the print image data generation unit 51*i*, and is image data for the display unit 13 to display a print image 160 (shown in FIG. 16) of the nail design, which corresponds to the print image data, thereon.

In the embodiment, after the print image data generated by the print image data generation unit 51*i* is printed for a minimum print unit (minimum print amount) or for a block unit which is a set of some minimum print units, the display image data generation unit 51*j* generates display image data corresponding to the print image data for the printed amount. Then, the print image 160 based on the display image data is combined with a nail image 132 (or an enlarged nail image 172) so that the print image 160 on the nail image 132 is displayed on the display unit 13. By repeating these until printing finishes, the print image 160 is displayed in accordance with the progress of the printing.

The progress detection unit 51*k* detects the progress of printing which has been progressed under the control of the print control unit 51*e*.

More specifically, the progress detection unit 51*k* identifies the nail T of each printing finger U1, the nail T being intended to undergo printing, as the nail T having already undergone printing (already-printed fingernail T), as the nail T currently under printing (under-printing fingernail T), or as the nail T still waiting its turn to undergo printing (not-yet-printed fingernail T).

In addition, in a case where the under-printing fingernail T exists, the progress detection unit 51*k* identifies, in the print image data being printed on the nail T, a region having already been printed on the nail T (printed region, hereinafter) and a region having not been printed on the nail T yet (non-printed region, hereinafter).

Moreover, the progress detection unit 51*k* identifies, in the display image data, a region (corresponding printed region, hereinafter) corresponding to the printed region and a region (corresponding non-printed region) corresponding to the non-printed region.

In the embodiment, the display control unit 51*f* controls the display unit 13 via the display driver 65 so as to make the display unit 13 display various images thereon.

In the embodiment, in a case where printing is performed on a plurality of printing fingers 131 (four fingers, the index finger, the middle finger, the ring finger and the little finger, for example), the display unit 13 displays all the nail images 132 of the nails T of the four printing fingers U1 thereon, and also displays the print image 160, which is to be printed on each of the nails T, on each of the nail images 132 thereon. (Note that in the second embodiment, the same print image is printed on the nails T of all the printing fingers U1. In addition, the display unit 13 displays, of the nails T of the printing fingers U1, the under-printing fingernail T (a finger image of the printing finger U1 including a nail image of the under-printing fingernail T, in the embodiment) in such a way as to be larger than the not-under-printing fingernails T (finger images of the printing fingers U1 including nail images of the not-under-printing fingernails T, in the embodiment). That is, the display unit 13 displays the under-printing fingernail T and the not-under-printing fingernails T in such a way that a ratio of a display size of the under-printing fingernail T to the actual size thereof is higher than a ratio of a display size of the not-under-printing fingernails T to the actual size thereof. The display sizes are sizes with which the fingernails T are displayed on the display unit 13. Furthermore, the display unit 13 displays the printed region and the non-printed region of the print image 160 being printed on the under-printing fingernail T to be distinguishable from each other.

Figure 15:
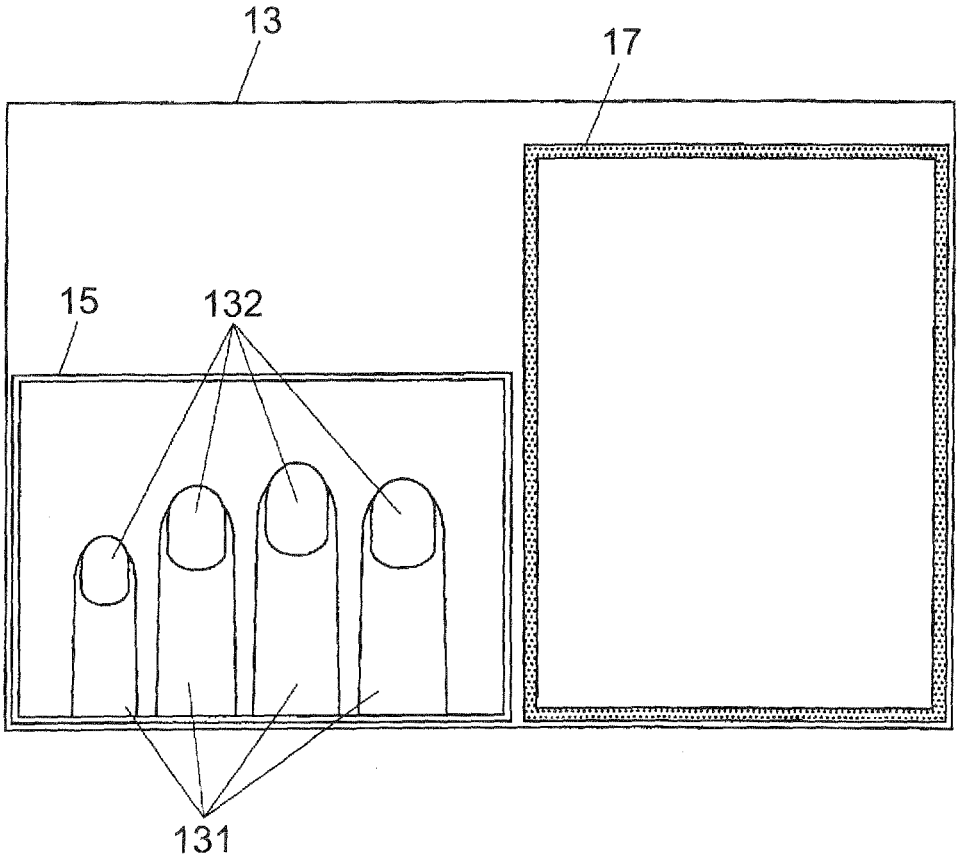
FIG. 15 shows an example of a display screen.
Figure 16:
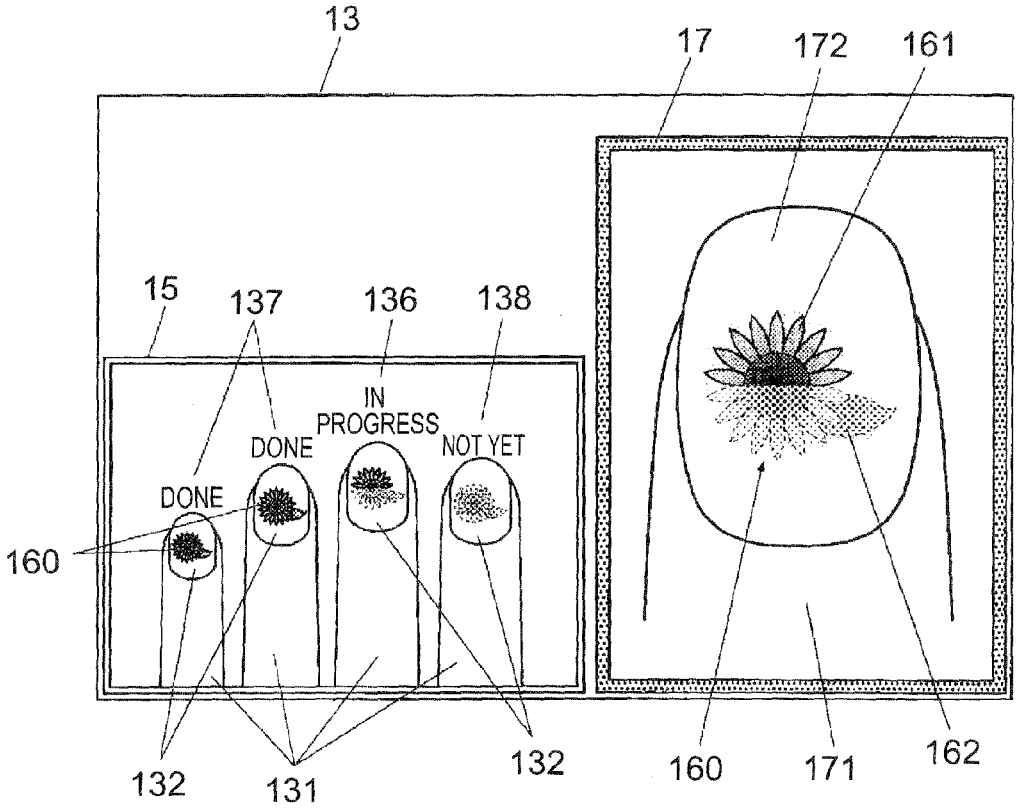
FIG. 16 shows another example of the display screen.

FIGS. 15 and 16 show examples of a display screen displayed on the display unit 13, which is controlled by the display control unit 51*f* in the embodiment.

As shown in FIGS. 15 and 16, the display unit 13 in the embodiment includes an all finger display region 15 and a progress display region 17. The all finger display region 15 is a region where the nails T of all the printing fingers U1 (finger images 131 of the printing fingers U1 including nail images 132 of the nails T, in the embodiment), the nails T which are intended to undergo printing, are displayed. The progress display region 17 is a region where, of the nails T of the printing fingers U1 (finger images 131 of the printing fingers U1 including nail images 132 of the nails T, in the embodiment), the under-printing fingernail T is displayed in such a way as to be enlarged (an enlarged display mode) (an enlarged finger image 171 of the printing finger U1 including the enlarged nail image (enlarged nail region) 172 of a nail image of the nail T, in the embodiment), and the printed region and the non-printed region of the print image 160 being printed on the under-printing fingernail T are displayed to be distinguishable from each other.

The sizes and positions of the all finger display region 15 and the progress display region 17 are not limited to these exemplified here. For example, in FIGS. 15 and 16, some space is left around the all finger display region 15 and the progress display region 17 on the display screen of the display unit 13. However, the all finger display region 15 and the progress display region 17 may occupy the entire display screen of the display unit 13.

In order to make the display unit 13 perform such display, the display control unit 51*f* in the embodiment controls the display unit 13 as follows.

That is, the image displayed in the all finger display region 15 of the display unit 13 includes finger images 131. The number of the finger images 131 is the same as the number of printing fingers U1 detected by the finger detection unit 51*c*. The finger images 131 are displayed side by side. Each finger image 131 includes a nail image 132. Like the first embodiment, the finger images 131 respectively correspond to the printing fingers U1, and are respectively correlated with the identification numbers (shown in FIG. 8).

In the embodiment, before printing starts, as shown in FIG. 15, the finger images 131 of the printing fingers U1 including the nail images 132 of the nails T which are intended to undergo printing are simply displayed side by side in the all finger display region 15. At the time, nothing is displayed in the progress display region 17.

Once printing starts, the finger images 131 are displayed in the all finger display region 15 in such a way that the finger image 131 correlated with the under-printing fingernail T, the finger image 131 correlated with the already-printed fingernail T, and the finger image 131 correlated with the not-yet-printed fingernail T are distinguished from each other.

More specifically, as shown in FIG. 16, on each of the nail images 132 displayed in the all finger display region 15, the print image 160 is displayed on the basis of the display image data. At the time, the display control unit 51*f* distinguishes between the corresponding printed region and the corresponding non-printed region of the print image 160, and displays the corresponding printed region in the non-transparent, display mode, which is a normal display mode, and the corresponding non-printed region in the semi-transparent display mode. The corresponding printed region corresponds to the printed region, and the corresponding non-printed region corresponds to the non-printed region. The regions are identified by the progress detection unit 51*k*. In addition, the display control unit 51*f* attaches the wording 136 "in progress" to the finger image 131 correlated with the under-printing fingernail T to display the finger image 131 with the wording 136, the wording 137 "done" to the finger image 131 correlated with the already-printed fingernail T to display the finger image 131 with the wording 137, and the wording 138 "not yet" to the finger image 131 correlated with the not-yet-printed fingernail T to display the finger images 131 with the wording 138.

Furthermore, in the progress display region 17, the enlarged finger image 171 corresponding to the printing finger U1 having the under-printing fingernail T is displayed. For example, in FIG. 16, a picked-up image (a finger image) of the printing finger U1 corresponding to the third finger image 131 from the left in the all finger display region 15, the picked-up image (finger image) being obtained by the image pickup control unit 51*b*, is enlarged, and displayed as the enlarged finger image 171. The displayed enlarged finger image 171 includes the enlarged nail image (enlarged nail region) 172.

The display control unit 51*f* combines the display image data with the picked-up image in such a way that the print image 160 is disposed inside the edge of the enlarged nail image 172 of the picked-up image obtained by the image pickup control unit 51*b* so as to display the print image 160 with the enlarged finger image 171 including the enlarged nail image 172 in the progress display region 17 of the display unit 13. At the time, as shown in FIG. 16, in the progress display region 17 of the display unit 13, a corresponding printed region 161 of the print image 160 is displayed in the non-transparent display mode, and a corresponding non-printed region 162 thereof is displayed in the semi-transparent display mode. That is, the display control unit 51*f* distinguishes between the corresponding printed region 161, which corresponds to the printed region, and the corresponding non-printed region 162, which corresponds to the non-printed region, in the print image 160, the regions being identified by the progress detection unit 51*k*, and controls the display unit 13 so that the corresponding printed region 161 is displayed on the display unit 13 in the non-transparent display mode, and the corresponding non-printed region 162 is displayed on the display unit 13 in the semi-transparent display mode. In the semi-transparent display mode, the pixel value of each pixel of the corresponding non-printed region 162 is an average value of the pixel value of its corresponding pixel of the corresponding non-printed region 162 displayed in the non-transparent display mode and the pixel value of its corresponding pixel of the background.

The other aspects of the configuration in the second embodiment are the same as those in the first embodiment. Hence, the components which are the same as those in the first embodiment are represented by the same reference numbers, and the description thereof is omitted.

Figure 17:
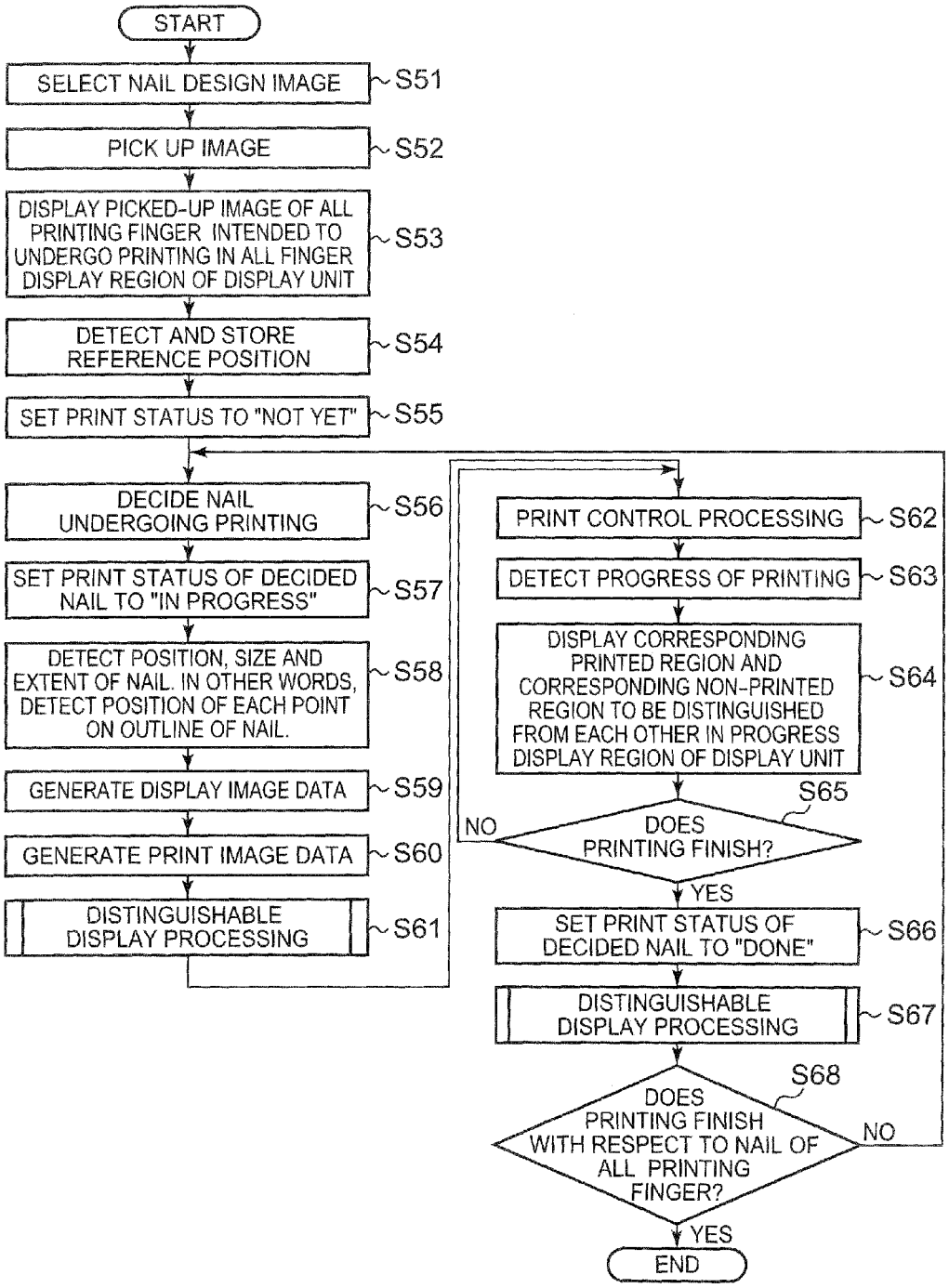
FIG. 17 is a flowchart showing processing performed by a control unit of the nail print apparatus in accordance with the second embodiment.

Next, referring to FIG. 17, processing performed by the central control unit 51 in accordance with the program 53 in the second embodiment is described, and also operation of the nail print apparatus 1 based on the processing performed by the central control unit 51 is described.

In order to perform printing with the nail print apparatus 1, like the first embodiment, a user first presses the power button 120 to start the control device 50, and chooses a nail design image which the user would like to print on the nail T of a printing finger U1 with the setting button 121 and the decision button 122 (Step S51). In the second embodiment, the same nail design image is chosen for all the printing fingers.

Then, the user inserts printing fingers U1 into the printing finger insertion unit 20*a*, and places the printing fingers U1 on the printing finger placement surface (the upper surface of the partition 21) with the nails T of the printing fingers U1 facing upward.

Next, when the user presses the print button 123, like the first embodiment, the central control unit 51 functions as the image pickup control unit 51*b*. Consequently, the central control unit 51 turns on the lights 33 and makes the electronic camera 32 perform image pickup operations (Step S52). When the electronic camera 32 performs the image pickup operations, the electronic camera 32 outputs picked-up images including finger images and nail images, and the central control unit 51 obtains the picked-up images.

Next, the central control unit 51 displays the picked-up images picked up by the electronic camera 32, namely, all the printing fingers U1 inserted into the printing finger insertion unit 20*a* because of being intended to undergo printing, in the all finger display region 15 of the display unit 13 (Step S53).

Next, the central control unit 51 functions as the finger detection unit 51*c*. Consequently, the central control unit 51 detects the number of printing fingers U1 on the basis of the picked-up images, and stores the detected number of printing fingers U1 in the memory 57.

Furthermore, like the first embodiment, the central control unit 51 functions as the nail position detection unit 51*d*. Consequently, the central control unit 51 detects the reference positions (Xa, Ya), (Xb, Yb), (Xc, Yc) and (Xd, Yd) of the nails T (nails Ta, Tb, Tc and Td) of the printing fingers U1 on the basis of the picked-up images (shown in FIG. 6), correlates the X coordinates of the detected reference positions (Xa, Ya), (Xb, Yb), (Xc, Yc) and (Xd, Yd) with the identification numbers, respectively, and stores the X coordinates in the X coordinate storage region 58*c*, and also correlates the Y coordinates of the detected reference positions (Xa, Ya), (Xb, Yb), (Xc, Ye) and (Xd, Yd) with the identification numbers, respectively, and stores the Y coordinates in the Y coordinate storage region 58*d* (Step S54).

Next, the central control unit 51 sets a print status correlated with all the identification numbers to "not yet" (Step S55). More specifically, the central control unit 51 correlates the print status "not yet" with all the identification numbers, and stores the print status in the print status storage region 58*b*.

Next, the central control unit 51 selects a printing finger U1 from among the printing fingers U1 so as to decide to perform printing on the nail T of the selected printing finger U1 (Step S56). More specifically, the central control unit 51 selects an identification number from the nail print control table 58.

Next, the central control unit 51 sets the print status correlated with the printing finger U1 having the nail T decided to undergo printing to "in progress" (Step S57). More specifically, the central control unit 51 changes the print status correlated with the identification number selected at Step S56 from "not yet" to "in progress", and stores the print status "in progress" in the print status storage region 58*b*.

Next, in the embodiment, the program 53 makes the central control unit 51 function as the nail region detection unit 51*g*. Consequently, the central control unit 51 detects the sizes and the extents of the nails T of the printing fingers U1 on the basis of the picked-up images (Step S58). That is, the central control unit 51 detects positions of points on the edge of the nail region included in each picked-up image, and converts the positions (coordinates) of each point on the edge of the nail region into positions (coordinates) of each point on the outline of the nail T.

Next, the program 53 makes the central control unit 51 function as the display image data generation unit 51*j*. Consequently, the central control unit 51 converts the coordinates of each pixel of the selected display nail design image 56*b* into coordinates in the picked-up image's coordinate system so as to generate the display image data (Step S59). That is, the central control unit 51 changes the size or the like of the selected display nail design image 56*b*, and also converts the coordinates of the display nail design image 56*b* into the coordinates in the picked-up image's coordinate system in such a way that the display nail design image 56*b* is disposed inside the edge of the nail region in the picked-up image.

Next, the program 53 makes the central control unit 51 function as the print image data generation unit 51*i*. Consequently, the central control unit 51 converts the coordinates of each pixel of the selected print nail design image 56*a* into coordinates in the XY Cartesian coordinate system so as to generate the print image data (Step S60). That is, the central control unit 51 changes the size or the like of the selected print nail design image 56*a*, and also converts the coordinates of the print nail design image 56*a* into the coordinates in the XY Cartesian coordinate system in such away that the print nail design image 56*a* is disposed inside the outline of the nail T. (Note that the position of each point on the outline of the nail T is shown in the XY Cartesian coordinate system.)

Next, the program 53 makes the central control unit 51 function as the display control unit 51*f*. Consequently, the central control unit 51 performs distinguishable display processing (Step S61). By the central control unit 51 performing the distinguishable display processing, the image shown in FIG. 16 is displayed in the all finger display region 15 of the display unit 13. The image displayed in the all finger display region 15 by the central control unit 51 performing the distinguishable display processing keeps being displayed during print control processing (Step S62) described below.

The contents of the distinguishable display processing at Step S61 are the same as those described in the first embodiment referring to FIG. 13, and hence the description thereof is omitted.

Next, the program 53 makes the central control unit 51 function as the print control unit 51*e*. Consequently, the central control unit 51 controls the print unit 40 via the print diver 60 so as to make the print head 46 of the print unit 40 perform printing operations (print control processing at Step S62). Consequently, the print head 46 of the print unit 40 performs printing on the nail T decided to undergo printing on the basis of the print image data.

The contents of the print control processing at Step S62 are the same as those described in the first embodiment, and hence the description thereof is omitted.

During printing, the program 53 makes the central control unit 51 function as the progress detection unit 51*k*. Consequently, the central control unit 51 identifies the printed region and the non-printed region in the print image data (Step S63). In addition, the central control unit. 51 identifies the corresponding printed region 161 and the corresponding non-printed region 161 in the print image 160.

Then, the program 53 makes the central control unit 51 function as the display control unit 51*f*. Consequently, as shown in FIG. 16, the central control unit 51 distinguishes between the corresponding printed region 161 and the corresponding non-printed region 162 so as to display the corresponding printed region 161 and the corresponding non-printed region 162 to be distinguished from each other in the progress display region 17 of the display unit 13 (Step S64). At the time, the central control unit 51 combines the print image 160 having the corresponding printed region 161 and the corresponding non-printed region 162 with the enlarged finger image 171 including the enlarged nail image 172 in such a way that the corresponding printed region 161 and the corresponding non-printed region 162 are disposed inside the edge of the enlarged nail image 172, and displays the enlarged finger image 171 with the print image 160 having the corresponding printed region 161 and the corresponding non-printed region 162 in the progress display region 17 of the display unit 13.

The central control unit 51 determines whether or not the printing finishes with respect to the nail T of the printing finger U1 (Step S65). While not determining that the printing finishes with respect to the nail T (Step S65; NO), the central control unit 51 repeats Steps S62 to S64. Consequently, the print head 46 of the print unit 40 keeps performing printing on the nail T of the printing finger U1 (Step S62), and the corresponding printed region 161 and the corresponding non-printed region 162 are displayed to be distinguished from each other in the progress display region 17 of the display unit 13 (Step S64). Every time Steps S62 to S64 are performed, the central control unit 51 detects the progress of printing (Step S63). Hence, as the printing progresses, the area of the corresponding non-printed region 162 decreases, and the area of the corresponding printed region 161 increases. Such change in the progress of printing is continuously reflected in the progress display region 17 of the display unit 13.

Then, the central control unit 51 determines whether or not all the regions of the print image data are printed on the nail T (the nail T decided to undergo printing at Step S56) of the printing finger U1 (Step S65). When the central control unit 51 determines that all the regions of the print image data are printed on the nail T (Step S65; YES), all the regions of the print image 160 (i.e. the whole print image 160) are displayed as the corresponding printed region 161 in the progress display region 17 of the display unit 13 in the non-transparent display mode.

Then, the central control unit 51 sets the print status correlated with the printing finger U1 having the nail T decided to undergo printing at Step S56 to "done" (Step S66). More specifically, the central control unit 51 changes the print status correlated with the identification number selected at Step S56 from "in progress" to "done", and stores the print status "done" in the print status storage region 58*b*.

Next, the central control unit 51 performs distinguishable display processing (Step S67). The distinguishable display processing at Step S67 is the same as that at Step S61. By the central control unit 51 performing the distinguishable display processing, the finger image 131 displayed in the display mode for "in progress" is displayed in the display mode for "done".

The central control unit 51 determines whether or not the printing finishes with respect to the nails T of all the printing fingers U1 inserted into the printing finger insertion unit 20*a* (Step S68). While not determining that the printing finishes with respect to the nails T of all the printing fingers U1 (Step S68; NO), the central control unit 51 repeats Steps S56 to S67. Consequently, the print head 46 of the print, unit 40 performs printing on the nails T of the printing fingers U1 inserted into the printing finger insertion unit 20*a* successively, and the finger image 131 correlated with the under-printing fingernail T (the identification number selected at Step S56) is displayed to be distinguished from the other finger images 131 in the all finger display region 15 of the display unit 13. When determining that the printing finishes with respect to the nails T of all the printing fingers U1, namely, when determining that Steps S56 to S67 finish with respect to all the identification numbers (Step S68; YES), the central control unit 51 ends the processing shown in FIG. 17.

The other aspects of the configuration in the second embodiment are the same as those in the first embodiment, and hence the description thereof is omitted.

As described above, according to the nail print apparatus 1 in the second embodiment, like the first embodiment, the finger image 131 for the under-printing fingernail T is displayed to be distinguished from the finger images 131 for the not-under-printing fingernails T. Accordingly, a user can recognize, of the nails T of the printing fingers U1 inserted into the printing finger insertion unit 20*a*, which nail T is under printing and which nail T is not under printing. Accordingly, the user can move the printing fingers U1 having the not-under-printing fingernails T. Because the user does not need to keep the printing fingers U1 having the not-under-printing fingernails T still, the user feels comfortable.

Furthermore, in the second embodiment, the progress of printing is detected, and always displayed in the progress display region 17 of the display unit 13. Accordingly, a user can instinctively/readily know the time during which a printing finger U1 should not be moved because the nail T thereof is under printing. Accordingly, the user can enjoy nail design processing (nail printing), feeling comfortable without feeling irritated, while waiting for the printing to be done.

Furthermore, a user can instinctively/readily know the time elapsed before printing starts on the nail T of the next printing finger U1. Consequently, during printing on the nail T of a printing finger U1, if a user feels something uncomfortable on the next printing finger U1, the user knows that the next printing finger U1 can be moved, by knowing how much time is left before printing starts on the nail T of the next printing finger U1. Accordingly, the user can enjoy nail design processing being more relaxed, feeling comfortable.

Furthermore, the display unit 13 includes the all finger display region 15 where the nails T of all the printing fingers U1 on which printing is performed are displayed, and the progress display region 17 where, among the nails T of the printing fingers U1, only the under-printing fingernail T is displayed in the enlarged display mode. Accordingly, a user can easily recognize overall progress of printing and detailed progress of printing, by just looking at the display unit 13. The overall progress of printing shows which nail T is under printing and which nail T is not under printing, of the nails T of all the printing fingers U1 intended to undergo printing. The detailed progress of printing shows progress of printing with respect to the under-printing fingernail T. Accordingly, it is convenient for the user.

In the progress display region 17 of the display unit 13, the under-printing fingernail T is displayed, so as to be larger than the not-under-printing fingernails T, and the corresponding printed region 161, which corresponds to the printed region, of the print image 160 being printed on the under-printing fingernail T is displayed to be distinguished from the corresponding non-printed region 162, which corresponds to the non-printed region, thereof. Accordingly, a user can easily know on which printing finger U1 and how far printing has progressed, so that the user can wait for the printing to be done, feeling comfortable.

Furthermore, in the progress display region 17, under the control of the display control unit 51*f*, the corresponding printed region 161, which corresponds to the printed region, is displayed in the non-transparent display mode, and the corresponding non-printed region 162, which corresponds to the non-printed region, is displayed in the semi-transparent display mode. Accordingly, a user can instinctively/readily know the progress of printing with respect to the under-printing fingernail T.

In the above, the embodiments of the present invention are described. However, the present invention is not limited thereto. Hence, it is needless to say that the present invention can be appropriately and variously modified without departing from the scope of the present invention.

For example, in the second embodiment, as shown in FIG. 16, in the progress display region 17 of the display unit 13, the corresponding printed region 161 of the print image 160 is displayed in the non-transparent display mode, and the corresponding non-printed region 162 thereof is displayed in the semi-transparent display mode. However, as long as the corresponding printed region 161 and the corresponding non-printed region 162 are displayed to be distinguished from each other on the display unit 13, the method therefor is not limited thereto.

Figure 18:
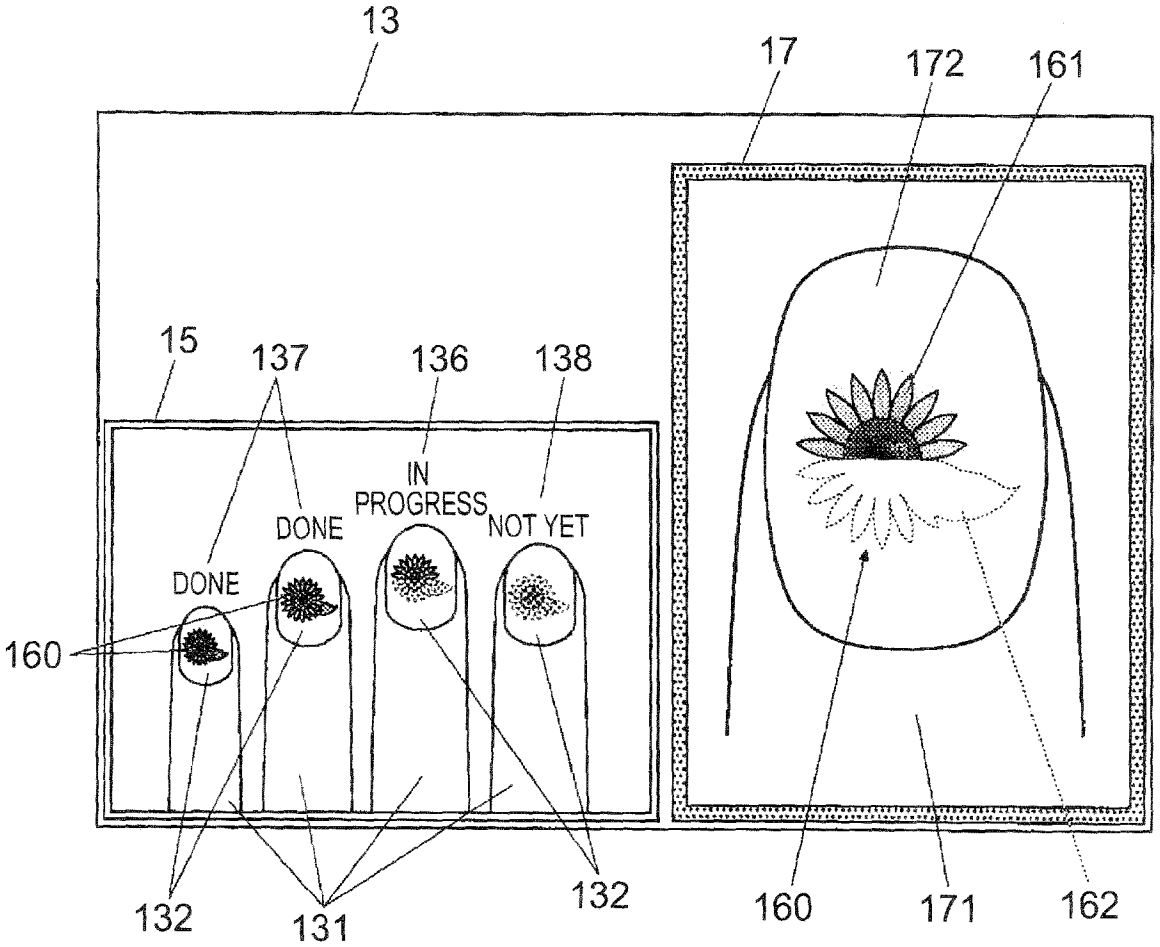
FIG. 18 shows a modification of the display screen.

For example, as shown in FIG. 18, it is possible, in the progress display region 17 of the display unit 13, to combine the print image 160 with the enlarged nail image 172 in such a way as to dispose the print image 160 inside the edge of the enlarged nail image 172, so as to display, of the print image 160, a region corresponding to the non-printed region (corresponding non-printed region 162) using an image in which the edge of the region is left but the inside thereof is blank (an inside blank display mode) and a region corresponding to the printed region (corresponding printed region 161) using not an image in which the edge of the region is left but the inside thereof is blank, but a non-transparent or semi-transparent image.

Thus, in the case too where, under the control of the display control unit 51, the corresponding non-printed region 162, which corresponds to the non-printed region, is displayed on the display unit 13 in the inside blank display mode, and the corresponding printed region 161, which corresponds to the printed region, is displayed on the display unit 13 not in the inside blank display mode, a user can easily know how far printing has progressed on the under-printing fingernail T, by just looking at the display unit 13. Accordingly, the user can wait for the printing to be done, feeling comfortable.

Figure 19:
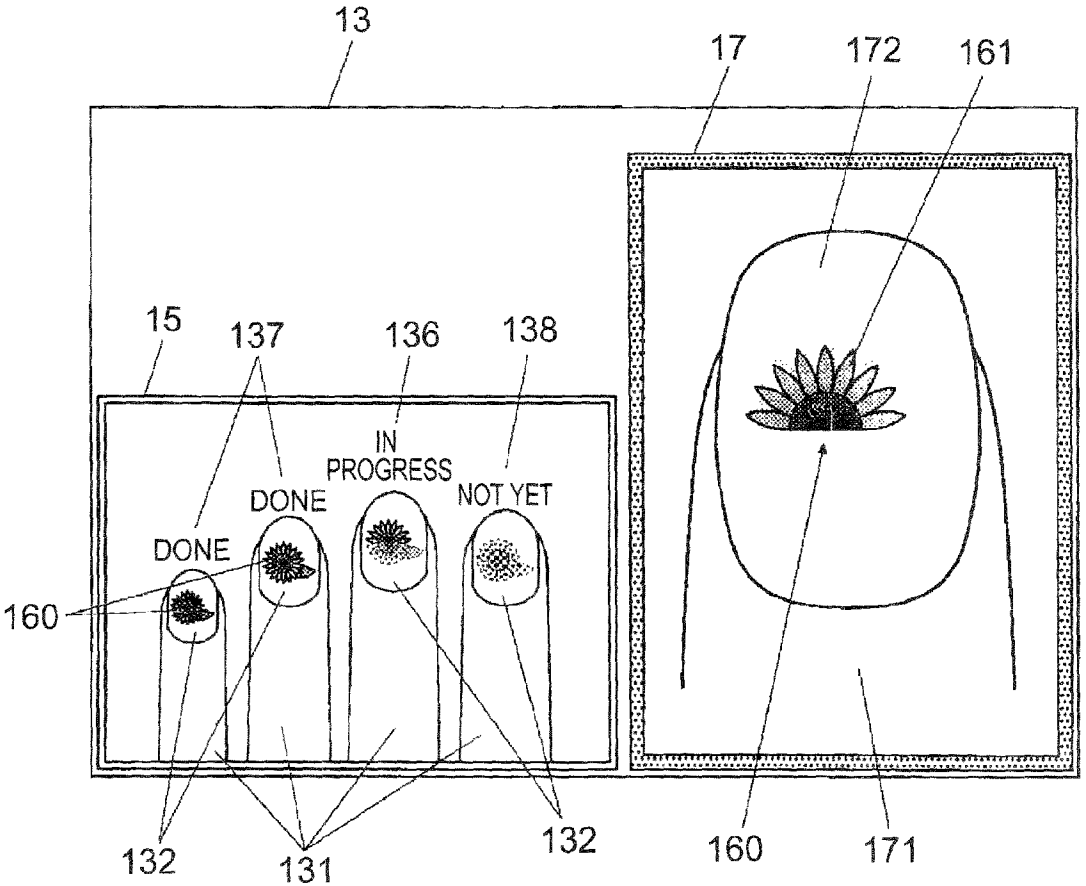
FIG. 19 shows another modification of the display screen.

Alternatively, for example, as shown in FIG. 19, possible, in the progress display region 17 of the display unit 13, to combine the print image 160 with the enlarged nail image 172 in such a way as to dispose the print image 160 inside the edge of the enlarged nail image 172, so as to display, of the print image 160, only a region corresponding to the printed region (corresponding printed region 161) in the non-transparent display mode or the semi-transparent display mode, thereby not displaying a region corresponding to the non-printed region (corresponding non-printed region 162).

Thus, in the case too where, under the control of the display control unit 51*f*, only the corresponding printed region 161, which corresponds to the printed region, is displayed on the display unit 13, and the corresponding non-printed region 162, which corresponds to the non-printed region, is not displayed, on the display unit, a user can easily know how far printing has progressed on the under-printing fingernail T, by just looking at the display unit 13. Accordingly, a user can wait for the printing to be done, feeing comfortable.

Alternatively, although not being shown, it is possible to display the corresponding non-printed region 162 in the blink display mode and the corresponding printed region 161 in the continuous display mode. In the case too, a user can easily know how far printing has progressed on the under-printing fingernail T, by just looking at the display unit 13. Accordingly, the user can wait for the printing to be done, feeing comfortable.

Furthermore, in the second embodiment, as shown in FIG. 15, the all finger display region 15 and the progress display region 17 are separately secured on the display screen of display unit 13 before printing starts. However, this is not a limit.

Figure 20:
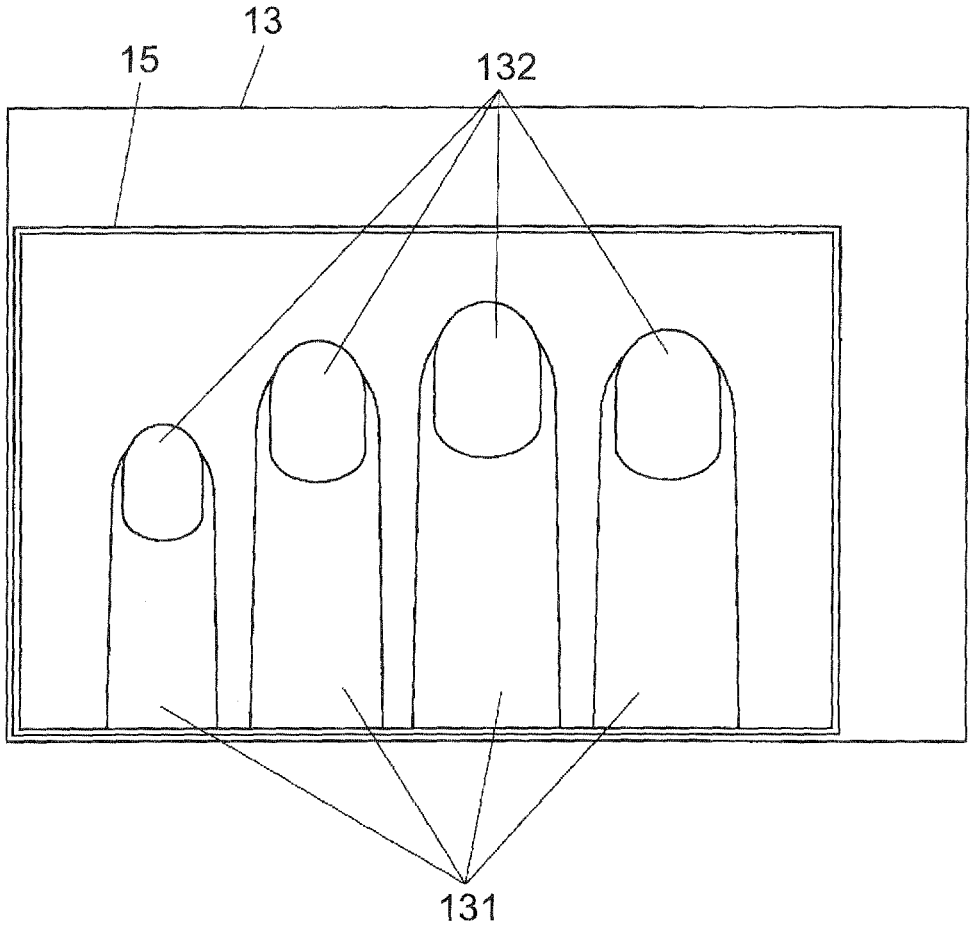
FIG. 20 shows another modification of the display screen.

For example, before printing starts, as shown in FIG. 20, only the all finger display region 15 may be displayed on the display screen of the display unit 13 largely, and the progress display region 17 may be secured on the display screen thereof after printing starts, by the whole or apart of the all finger display region 15 being reduced.

Figure 21:
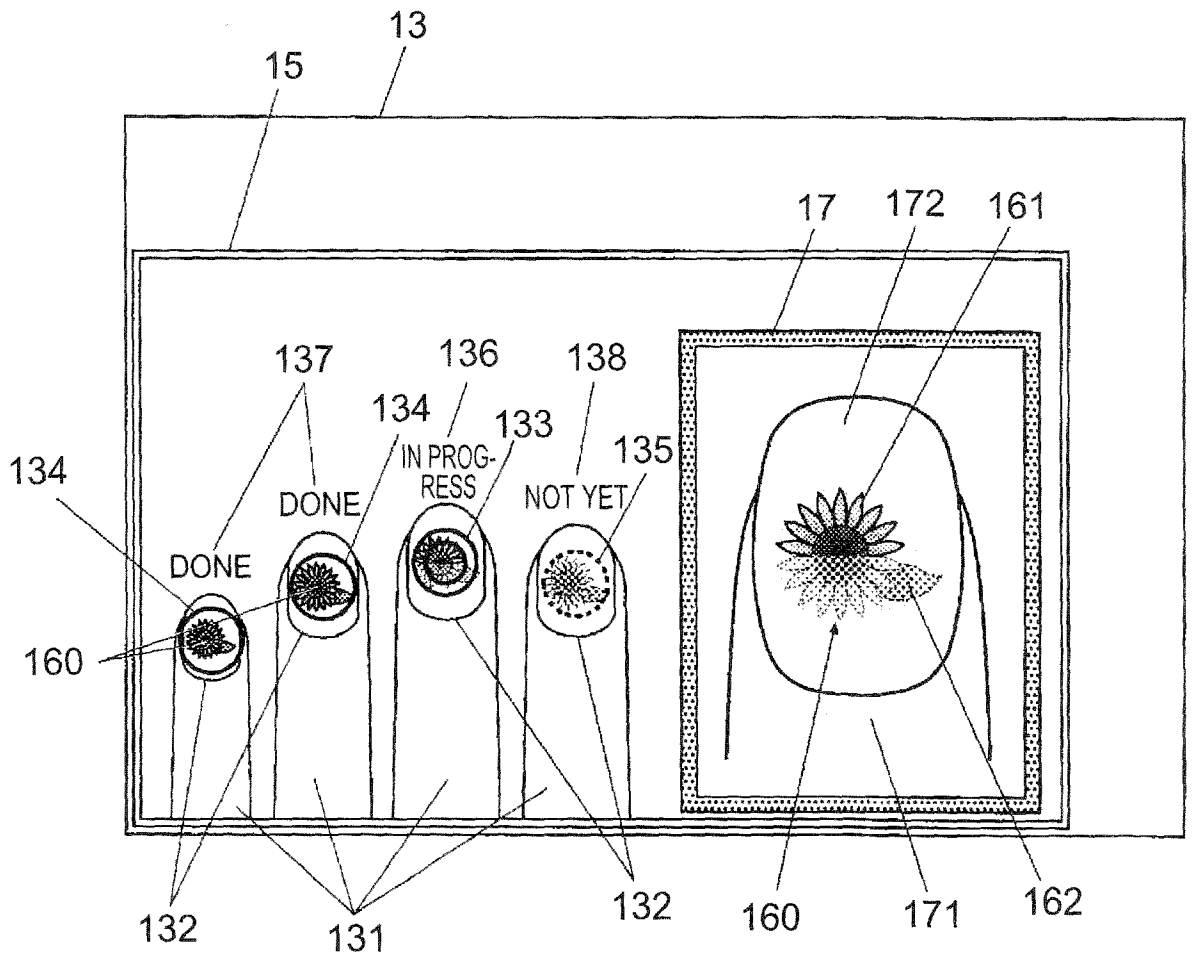
FIG. 21 shows another modification of the display screen.

More specifically, for example, as shown in FIG. 21, a part of the all finger display region 15, the part where the finger images 131 of all the printing fingers U1 are displayed, may be reduced after printing starts, so that the progress display region 17 can be secured in the space, which becomes unoccupied, in the all finger display region 15. Alternatively, although not being shown, the whole of the all finger display region 15 may be reduced after printing starts, so that the progress display region 17 can be secured in the space, which becomes unoccupied, in the display screen of the display unit 13.

Thus, in the case where the progress display region 17 is secured on the display unit 13 by the whole or a part of the all finger display region 15 being reduced after printing starts, the all finger display region 15 can be secured largely before printing starts. Accordingly, a user can easily confirm how printing fingers U1 are placed or the like on the display unit 13.

Furthermore, in the second embodiment, the all finger display region 15 and the progress display region 17 are provided on the display unit 13. However, the configuration of the display screen of the display unit 13 is not limited thereto.

Figure 22:
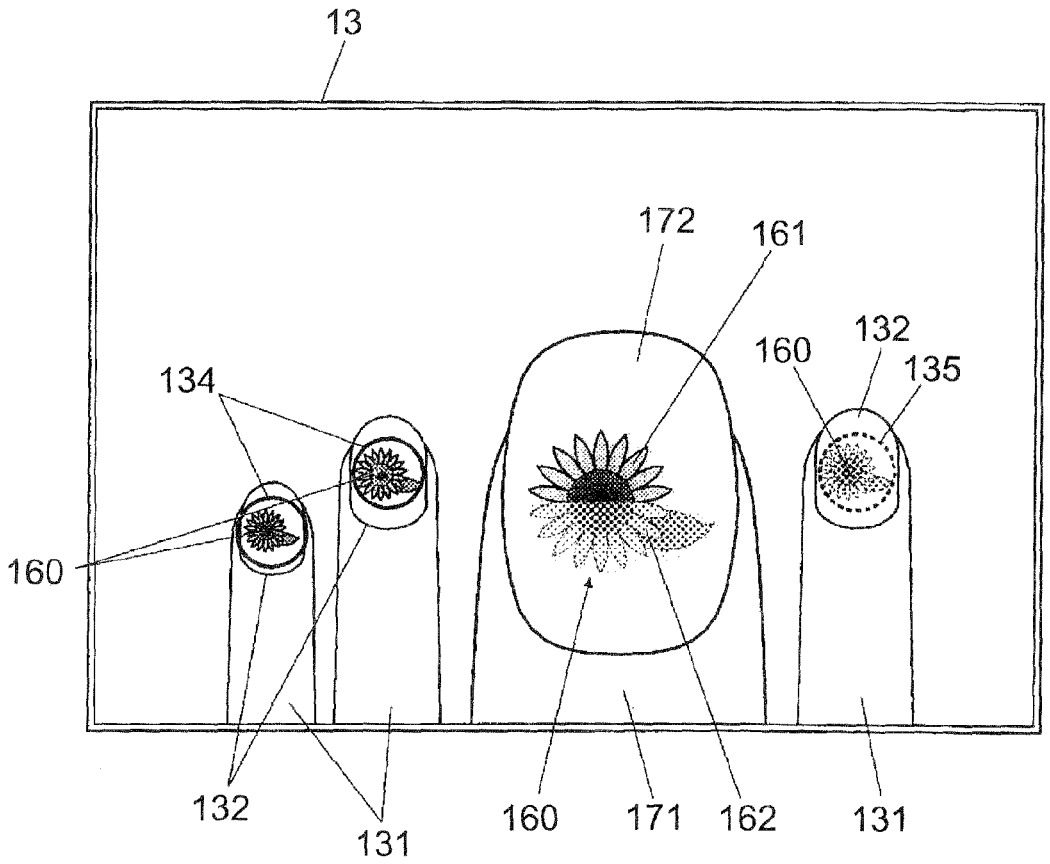
FIG. 22 shows another modification of the display screen.

For example, as shown in FIG. 22, the display unit 13 may be configured not to have the all finger display region 15 and the progress display region 17. Instead, the display unit 13 may be configured to display the nails T of all the printing fingers U1, on which printing is performed, and to display the under-printing fingernail T more largely than the not-under-printing fingernails T. In this case, of the print image 160 being printed on the under-printing fingernail T, the corresponding printed region 161 and the corresponding non-printed region 162 are displayed to be distinguished from each other on the enlarged finger image 171, which includes the enlarged nail image 172.

Figure 23:
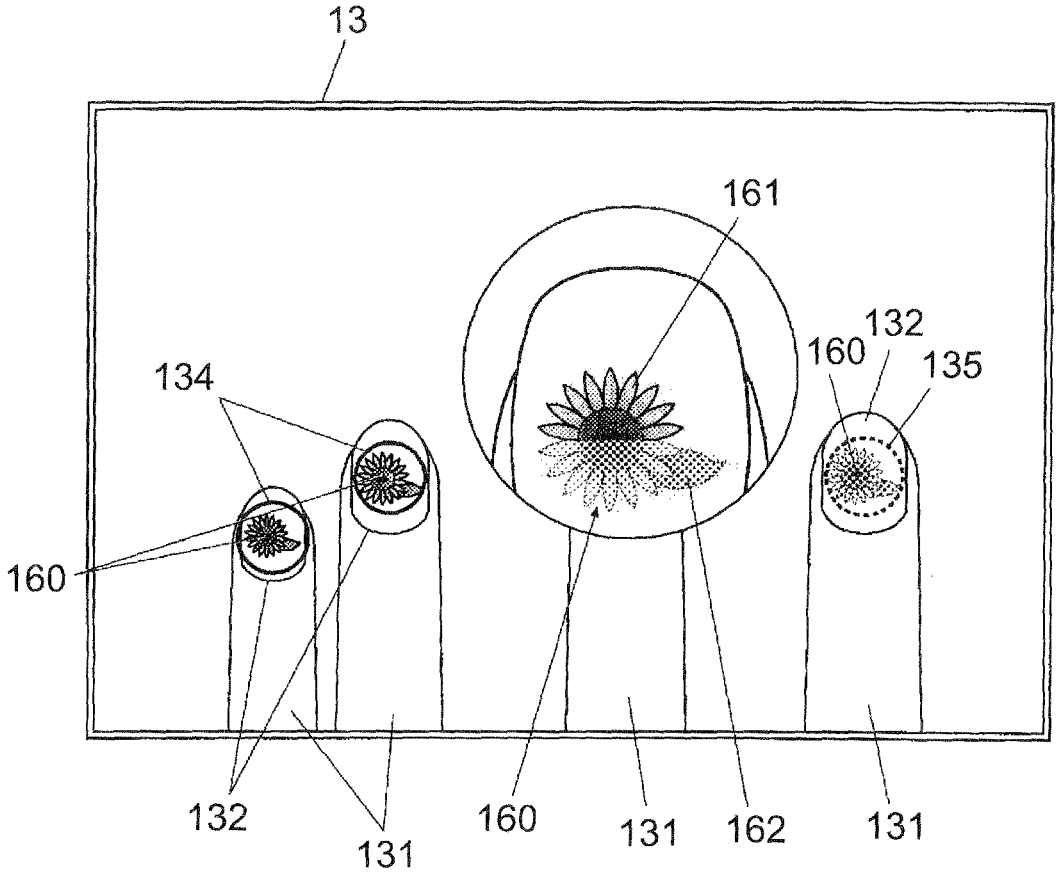
FIG. 23 shows another modification of the display screen.

Alternatively, as shown in FIG. 23, only the print image 160 being printed on the under-printing fingernail T may be enlarged to be a circular enlarged image as if the print image 160 is looked at using a magnifying glass. In this case too, a user can easily know on which printing finger U1 and how far printing has progressed, so that the user can wait for the printing to be done, feeing comfortable.

Furthermore, in the second embodiment, as a method for displaying the under-printing fingernail T to be distinguished from the not-under-printing fingernails T on the display unit 13, the print image 160 is combined with each finger image 131 in such a way as to be disposed inside the edge of the nail image 132 included in the finger image 131, and the whole print image 160 is displayed in the non-transparent display mode for the already-printed fingernail T, the whole print image 160 is displayed in the semi-transparent display mode for the not-yet-printed fingernail T, and the corresponding printed region of the print image 160 and the corresponding non-printed region thereof are respectively displayed in the non-transparent display mode and the semi-transparent display mode for the under-printing fingernail T. In addition, the wordings 136 to 138 such as "in progress" are displayed. However, the display mode for displaying the under-printing fingernail T to be distinguished from the not-under-printing fingernails T is not limited thereto.

For example, as shown in FIGS. 21 and 22, the under-printing fingernail T may be distinguished from the not-under-printing fingernails T by attaching predetermined marks, such as the marks 133 to 135, to the nail images 132 of the finger images 131. In the embodiment, the mark 133 is a double circle shown by a solid line for the under-printing fingernail T, the mark 134 is a circle shown by a solid line for the already-printed fingernail T, and the mark 135 is a circle shown by a broken line for the not-yet-printed fingernail T.

Furthermore, as described in the first embodiment, the under-printing fingernail T may be distinguished from the not-under-printing fingernails T by attaching an arrow or the like to the under-printing fingernail T, or by displaying the whole finger image 132 or the nail image 132 for the under-printing fingernail T in the blink display mode or the semi-transparent display mode, for example.

Furthermore, as shown in FIG. 21, the under-printing fingernail T may be distinguished from the not-under-printing fingernails T by combining the print image 160 with each finger image 131 in such a way as to dispose the print image inside the nail image 132, by displaying the marks 133 to 135, by displaying the wordings 136 to 138, and/or the like. Alternatively, the under-printing fingernail T may be distinguished from the not-under-printing fingernails T by displaying the under-printing fingernail T more largely than the not-under-printing fingernails T without displaying the print image 160, the marks 133 to 135, the wording 136 to 138 and the like.

The methods for displaying the under-printing fingernail T to be distinguished from the not-under-printing fingernails T on the display unit 13 and the methods for displaying the corresponding printed region and the corresponding non-printed region with respect to the under-printing fingernail T to be distinguished from each other, which are described in the first and second embodiments, can be appropriately combined.

Figure 24:
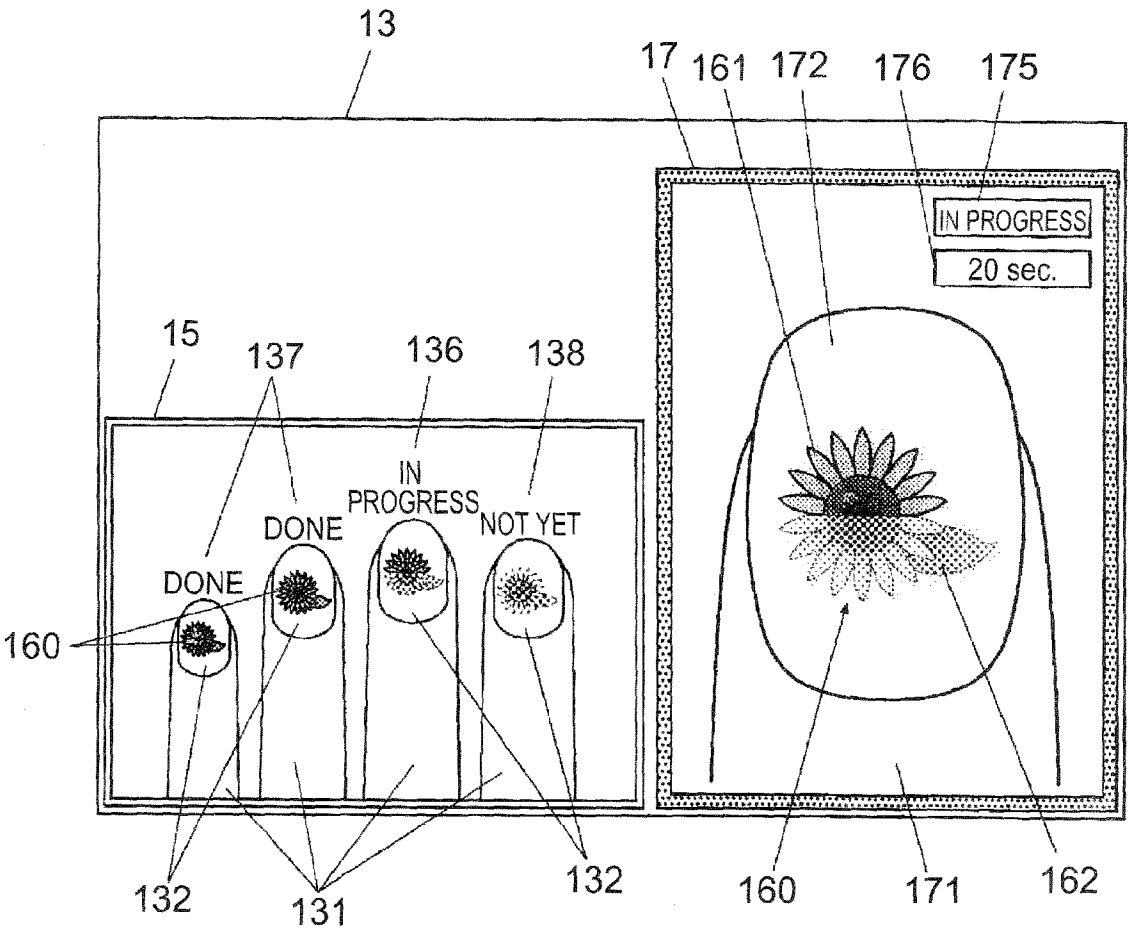
FIG. 24 shows another modification of the display screen.

Furthermore, as shown in FIG. 24, the display control unit 51*f* may dispose a print status display region 175 in the progress display region 17 of the display unit 13. The print status display region 175 is a region where a message that the nail T displayed in the progress display region 17 is under printing ("in progress") is displayed.

Such display makes it clear that the nail T displayed in the progress display region 17 of the display unit 13 is under printing. Accordingly, a user can more easily know that the nail T displayed in the progress display region 17 is under printing.

Furthermore, as shown in FIG. 24, the display control unit 51*f* may dispose a remaining time display region 176 in the display unit 13, and display the remaining time in a numerical value in the remaining time display region 176. The remaining time is time left before printing being progressed under the control of the print control unit 51*e* finishes. In FIG. 24, the remaining time display region 176 is disposed in the progress display region 17 of the display unit 13. However, the position where the remaining time display region 176 is disposed, the size thereof and the like are not limited to those exemplified here.

In this case, the central control unit 51 also functions as a remaining time calculation unit which calculates the remaining time left before printing being progressed under the control of the print control unit 51*e* finishes.

That is, in this case, the central control unit 51 calculates a print time required to print a print image from the print image data on a nail T. The print time is a period of time from the time printing on the nail T of a printing finger U1 starts with the print unit 40 to the time the printing finishes.

The print time calculated by the central control unit 51 as the remaining time calculation unit is displayed on the display unit 13 with the finger image 131 (or the enlarged finger image 171) when printing starts.

During printing, the central control unit 51 as the remaining time calculation unit calculates the elapsed time elapsed from the start of the printing, and also calculates a difference (a print remaining time, hereinafter) obtained by subtracting the elapsed time from the print time calculated before the printing starts.

Then, during the printing, the print remaining time calculated by the central control unit 51 is displayed on the display unit 13 with the finger image 131 (or the enlarged finger image 171). The print remaining time is displayed in a numerical value.

Figure 25:
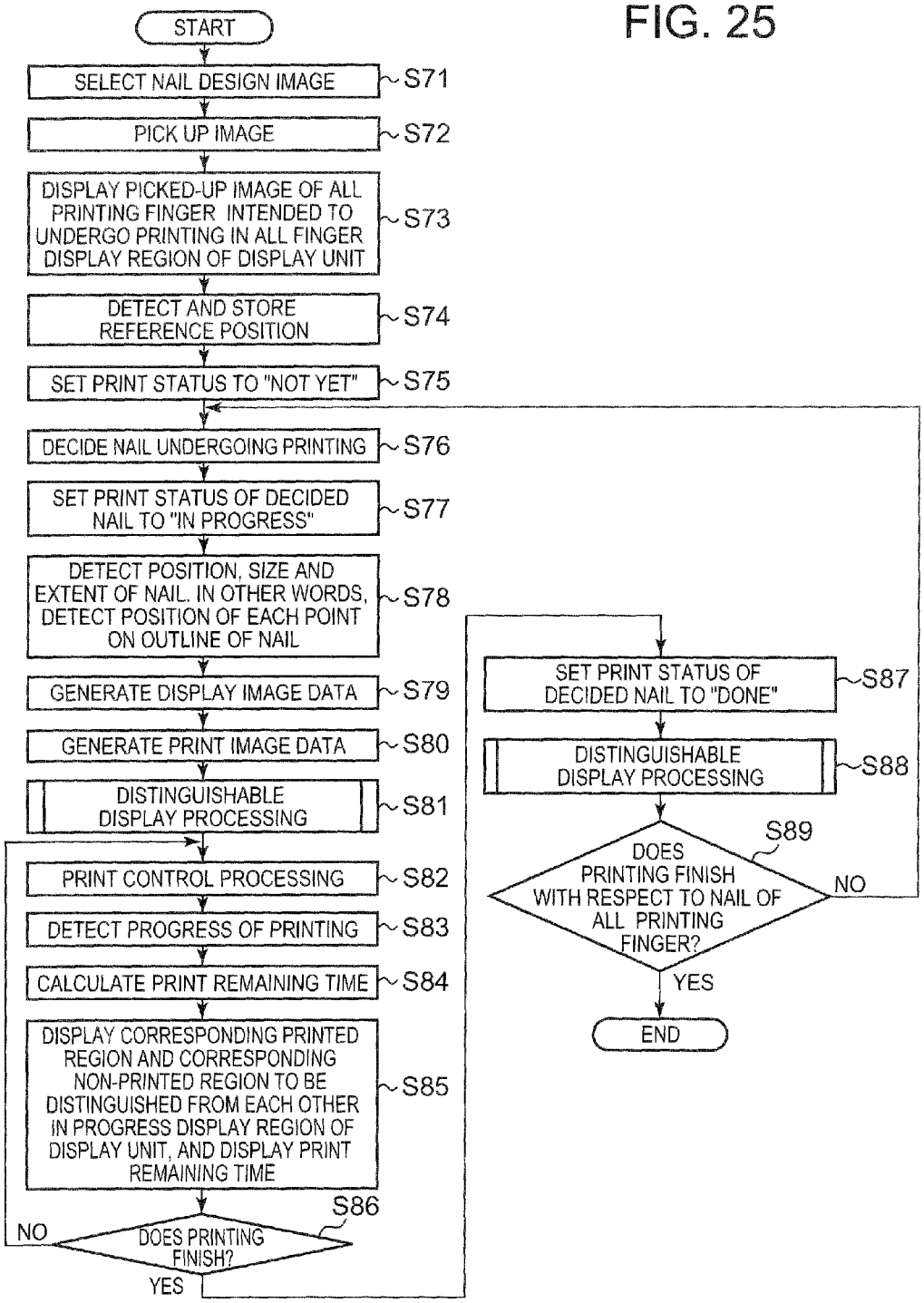
FIG. 25 is a flowchart showing processing performed by the control unit, of the nail print apparatus in accordance with a modification of the second embodiment.

Referring to FIG. 25, processing performed by the central control unit 51 in accordance with the program 53 in the case where the print remaining time is displayed is described, and also operation of the nail print apparatus 1 based on the processing performed by the central control unit 51 in this case is described.

As shown in FIG. 25, in the case where the print remaining time is displayed, the central control unit 51 as the print control unit 51*e* starts the print control processing (Step S82) the central control unit 51 as the progress detection unit 51*h* detects the progress of printing (Step S83), and the central control unit 51 as the remaining time calculation unit calculates the elapsed time elapsed from the start of the printing, and calculates the print remaining time by subtracting the elapsed time from the print time calculated before the printing starts (Step S84). Then, the corresponding printed region and the corresponding non-printed region are displayed to be distinguished from each other in the progress display region 17 of the display unit 13, and the print remaining time is displayed in the remaining time display region 176 (Step S85). Steps S71 to S83 and Steps S86 to S89 in FIG. 25 are the same as Steps S51 to S63 and Steps S65 to S68 in FIG. 17, and hence the description thereof is omitted.

Thus, in the case where the remaining time display region 176 where the print remaining time is displayed is provided, and the print remaining time is displayed on the display unit 13, a user can more accurately know the time left before the printing finishes. Accordingly, a user can wait for the printing to be done, feeling comfortable.

The display size of the nail T of a printing finger U1 displayed on the display unit 13 may be the same as, larger than, or smaller than the actual size thereof. However, in this case too, a ratio of the display size of the under-printing fingernail T to the actual size thereof is made to be higher than a ratio of the display size of the not-under-printing fingernails T to the actual size thereof.

The embodiments disclosed above are examples in all the aspects and the present invention is not limited to the embodiments. Therefore, the scope of the present invention is intended to be limited not by the above description but solely by the scope of the claims and equivalents to the claims within the meaning and range thereof, and all the modifications are to be included.

According to an aspect of the preferred embodiments of the present invention, there is provided a nail print apparatus including: a print head which performs printing on a plurality of fingernails; and a display control unit which distinguishes between an under-printing fingernail under the printing performed by the print head and a not-under-printing fingernail not under the printing performed by the print head to display the fingernails.

Preferably, the nail print apparatus further includes a display unit, wherein the display control unit displays all the fingernails on the display unit, and displays a print image printed on the fingernails on the display unit, and the display control unit displays the fingernails on the display unit in such a way that a ratio of a display size to an actual size of the under-printing fingernail is higher than a ratio of a display size to an actual size of the not-under-printing fingernail, the display sizes with which the fingernails are displayed on the display unit.

Preferably, the nail print apparatus further includes: a display unit; and a progress detection unit which detects progress of the printing to identify the under-printing fingernail and the not-under-printing fingernail in the fingernails and to identify a printed region and a non-printed region in a print image printed on the fingernails, wherein the display control unit controls display on the display unit in accordance with a result of the detection by the progress detection unit.

Preferably, in the nail print apparatus, the display unit includes: an all finger display region where all the fingernails are displayed; and a progress display region where the under-printing fingernail is displayed in such a way as to be enlarged, and the printed region and the non-printed region are displayed to be distinguishable from each other.

Preferably, in the nail print apparatus, the progress display region is secured on the display unit by the whole or a part of the all finger display region being reduced after the printing starts.

Preferably, in the nail print apparatus, the display control unit, displays a corresponding printed region which corresponds to the printed region on the display unit in such a way as to be non-transparent, and displays a corresponding non-printed region which corresponds to the non-printed region on the display unit in such a way as to be semi-transparent.

Preferably, in the nail print apparatus, the display control unit displays a corresponding non-printed region which corresponds to the non-printed region on the display unit in such a way as to make an inside blank with an edge left, and displays a corresponding printed region which corresponds to the printed region on the display unit in such a way as not to make an inside blank.

Preferably, in the nail print apparatus, the display control unit displays a corresponding printed region which corresponds to the printed region on the display unit, and does not display a corresponding non-printed region which corresponds to the non-printed region.

Preferably, in the nail print apparatus, the display control unit displays a corresponding printed region which corresponds to the printed region on the display unit continuously, and displays a corresponding non-printed region which corresponds to the non-printed region on the display unit in such a way as to blink.

Preferably, the nail print apparatus further includes a remaining time calculation unit which calculates a remaining time remaining before the printing on the under-printing fingernail finishes, wherein the display control unit displays the remaining time, a corresponding printed region which corresponds to the printed region, and a corresponding non-printed region which corresponds to the non-printed region on the display unit.

Preferably, in the nail print apparatus, the display control unit attaches a first mark to a first finger image for the under-printing fingernail to display the first finger image with the first mark on the display unit.

Preferably, in the nail print apparatus, the display control unit attaches a second mark which is different from the first mark to a second finger image for the not-under-printing fingernail to display the second finger image with the second mark on the display unit.

Preferably, in the nail print apparatus, the display control unit attaches a first wording to a first finger image for the under-printing fingernail to display the first finger image with the first wording on the display unit, and attaches a second wording which is different from the first wording to a second finger image for the not-under-printing fingernail to display the second finger image with the second wording on the display unit.

Preferably, in the nail print apparatus, the display control unit attaches a wording only to a finger image for the under-printing fingernail among finger images for the fingernails to display the finger image with the wording on the display unit.

Preferably, in the nail print apparatus, the display control unit attaches an arrow only to a finger image for the under-printing fingernail among finger images for the fingernails to display the finger image with the arrow on the display unit.

Preferably, in the nail print apparatus, the display control unit displays a first finger image for the under-printing fingernail on the display unit in such a way as to blink, and displays a second finger image for the not-under-printing fingernail on the display unit continuously.

Preferably, in the nail print apparatus, the display control unit displays a first finger image for the under-printing fingernail on the display unit continuously, and displays a second finger image for the not-under-printing fingernail on the display unit in such a way as to blink.

Preferably, in the nail print apparatus, the display control unit displays a first finger image for the under-printing fingernail on the display unit in such a way as to be semi-transparent, or displays a second finger image for the not-under-printing fingernail on the display unit in such a way as to be semi-transparent.

Preferably, in the nail print apparatus, the not-under-printing fingernail includes an already-printed fingernail on which the printing is already performed and a not-yet-printed fingernail on which the printing is not performed yet, and the display control unit distinguishes between a finger image for the already-printed fingernail and a finger image for the not-yet-printed fingernail to display the finger images on the display unit.

This application is based upon and claims the benefit of priority under 35 USC 119 of Japanese Patent Application No. 2011-215109 filed on Sep. 29, 2011, and Japanese Patent Application No. 2012-150047 filed on Jul. 4, 2012, the entire disclosure of which, including the descriptions, claims, drawings, and abstracts, is incorporated herein by reference in its entirety.

What is claimed is:

1. A nail print apparatus comprising:

a print head which performs printing on a plurality of fingernails;

a display unit; and a display control unit which distinguishes between an under-printing fingernail undergoing the printing performed by the print head and a not-under-printing fingernail not undergoing the printing performed by the print head when performing control to display the fingernails;

wherein the display control unit performs control to display all of the fingernails on the display unit, and to display a print image printed on the fingernails on the display unit; and wherein the display control unit performs control to display the fingernails on the display unit in such a way that a ratio of a display size to an actual size of the under-printing fingernail is higher than a ratio of a display size to an actual size of the not-under-printing fingernail, the display sizes being sizes at which the fingernails are displayed on the display unit.

2. The nail print apparatus according to claim 1, wherein the display unit includes:

an all finger display region in which all the fingernails are displayed; and a progress display region in which the under-printing fingernail is displayed in such a way as to be enlarged and in which a printed region and a non-printed region in the print image printed on the fingernails are displayed to be distinguishable from each other.

3. The nail print apparatus according to claim 2, wherein the progress display region is secured on the display unit by reducing an entirety or a part of the all finger display region after the printing starts.

4. The nail print apparatus according to claim 1, further comprising:

a progress detection unit which detects progress of the printing to identify the under-printing fingernail and the not-under-printing fingernail and to identify a printed region and a non-printed region in the print image printed on the fingernails, wherein the display control unit controls the display unit to perform display in accordance with a result of the detection by the progress detection unit.

5. The nail print apparatus according to claim 4, wherein the display control unit performs control to display a corresponding printed region which corresponds to the printed region on the display unit in such a way as to be non-transparent, and to display a corresponding non-printed region which corresponds to the non-printed region on the display unit in such a way as to be semi-transparent.

6. The nail print apparatus according to claim 4, wherein the display control unit performs control to display a corresponding non-printed region which corresponds to the non-printed region on the display unit in such a way as to make an inside of the corresponding non-printed region blank with only an edge thereof remaining, and to display a corresponding printed region which corresponds to the printed region on the display unit in such a way as not to make an inside of the corresponding printed region blank.

7. The nail print apparatus according to claim 4, wherein the display control unit performs control to display a corresponding printed region which corresponds to the printed region on the display unit, and to not display a corresponding non-printed region which corresponds to the non-printed region on the display unit.

8. The nail print apparatus according to claim 4, wherein the display control unit performs control to display a corresponding printed region which corresponds to the printed region on the display unit continuously, and to display a corresponding non-printed region which corresponds to the non-printed region on the display unit in such a way as to blink.

9. The nail print apparatus according to claim 4, further comprising a remaining time calculation unit which calculates a remaining time remaining before the printing on the under-printing fingernail finishes, wherein the display control unit performs control to display (i) the remaining time, (ii) a corresponding printed region which corresponds to the printed region, and (iii) a corresponding non-printed region which corresponds to the non-printed region on the display unit.

10. The nail print apparatus according to claim 1, wherein the display control unit performs control to attach a first mark to a first finger image for the under-printing fingernail so as to display the first finger image with the first mark on the display unit.

11. The nail print apparatus according to claim 10, wherein the display control unit performs control to attach a second mark which is different from the first mark to a second finger image for the not-under-printing fingernail so as to display the second finger image with the second mark on the display unit.

12. The nail print apparatus according to claim 1, wherein the display control unit performs control to attach a first wording to a first finger image for the under-printing fingernail so as to display the first finger image with the first wording on the display unit, and to attach a second wording which is different from the first wording to a second finger image for the not-under-printing fingernail so as to display the second finger image with the second wording on the display unit.

13. The nail print apparatus according to claim 1, wherein the display control unit performs control to attach a wording only to a finger image for the under-printing fingernail among finger images for the fingernails so as to display the finger image with the wording on the display unit.

14. The nail print apparatus according to claim 1, wherein the display control unit performs control to attach an arrow only to a finger image for the under-printing fingernail among finger images for the fingernails so as to display the finger image with the arrow on the display unit.

15. The nail print apparatus according to claim 1, wherein the display control unit performs control to display a first finger image for the under-printing fingernail on the display unit in such a way as to blink, and to display a second finger image for the not-under-printing fingernail on the display unit continuously.

16. The nail print apparatus according to claim 1, wherein the display control unit performs control to display a first finger image for the under-printing fingernail on the display unit continuously, and to display a second finger image for the not-under-printing fingernail on the display unit in such a way as to blink.

17. The nail print apparatus according to claim 1, wherein the display control unit performs control to display one of (i) a first finger image for the under-printing fingernail on the display unit in such a way as to be semi-transparent, and (ii) a second finger image for the not-under-printing fingernail on the display unit in such a way as to be semi-transparent.

18. The nail print apparatus according to claim 1, wherein the not-under-printing fingernail includes an already-printed fingernail on which the printing has already been performed and a not-yet-printed fingernail on which the printing has not yet been performed, and wherein the display control unit performs control to distinguish between a finger image for the already-printed fingernail and a finger image for the not-yet-printed fingernail and to display the finger images on the display unit.

* * * * *